US011608582B2

(12) United States Patent
Jeon et al.

(10) Patent No.: US 11,608,582 B2
(45) Date of Patent: Mar. 21, 2023

(54) WASHING MACHINE

(71) Applicant: LG Electronics Inc., Seoul (KR)

(72) Inventors: Hoil Jeon, Seoul (KR); Hyewon Kim, Seoul (KR); Miju Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 221 days.

(21) Appl. No.: 16/962,366

(22) PCT Filed: Jan. 15, 2019

(86) PCT No.: PCT/KR2019/000599
§ 371 (c)(1),
(2) Date: Jul. 15, 2020

(87) PCT Pub. No.: WO2019/139454
PCT Pub. Date: Jul. 18, 2019

(65) Prior Publication Data

US 2021/0071337 A1 Mar. 11, 2021

(30) Foreign Application Priority Data

Jan. 15, 2018 (KR) ..... 10-2018-0005234
Feb. 14, 2018 (KR) ..... 10-2018-0018769
(Continued)

(51) Int. Cl.
*D06F 31/00* (2006.01)
*D06F 37/16* (2006.01)
(Continued)

(52) U.S. Cl.
CPC ..... *D06F 37/16* (2013.01); *D06F 23/04* (2013.01); *D06F 31/00* (2013.01); *D06F 37/267* (2013.01); *D06F 39/083* (2013.01)

(58) Field of Classification Search
CPC ..... D06F 37/16; D06F 37/267; D06F 23/04; D06F 31/00; D06F 39/83
(Continued)

(56) References Cited

FOREIGN PATENT DOCUMENTS

CN 1508348 6/2004
JP 2017148090 8/2017
(Continued)

OTHER PUBLICATIONS

WO2017217810A1—machine translation (Year: 2017).*
(Continued)

*Primary Examiner* — Tinsae B Ayalew
(74) *Attorney, Agent, or Firm* — Fish & Richardson P.C.

(57) ABSTRACT

A washing machine includes a first washing tub, and a second washing tub detachably coupled to the first washing tub. The second washing tub includes a container containing laundry, a lower cover coupled to a top of the container and having an inlet configured to receive a water stream moving upwards in the container when the first washing tub rotates, and an upper cover coupled to a top of the lower cover and having an opening for putting the laundry into the container. A flow path is provided between the lower cover and the upper cover to discharge the water stream introduced through the inlet to an outside of the second washing tub. A slide lock is provided on the upper cover, movable between a binding position and an unbinding position, bound to the lower cover in the binding position, and separated from the lower cover in the unbinding position.

10 Claims, 39 Drawing Sheets

(30) Foreign Application Priority Data

Mar. 29, 2018 (KR) ..... 10-2018-0036520
Apr. 13, 2018 (KR) ..... 10-2018-0043267

(51) Int. Cl.
*D06F 23/04* (2006.01)
*D06F 37/26* (2006.01)
*D06F 39/08* (2006.01)

(58) Field of Classification Search
USPC ..... 68/27
See application file for complete search history.

(56) References Cited

FOREIGN PATENT DOCUMENTS

| | | |
|---|---|---|
| KR | 20150030806 | 3/2015 |
| KR | 20150089344 | 8/2015 |
| KR | 20160084078 | 7/2016 |
| KR | K20160127681 | 11/2016 |
| WO | WO2017217810 | 12/2017 |

OTHER PUBLICATIONS

International Search Report in International Appln. No. PCT/KR2019/000599, dated May 15, 2 019, 5 pages (with English translation).
Office Action in Chinese Appln. No. 201980018644.4, dated May 10, 2022, 15 pages (with English translation).

* cited by examiner (b)

(a)

WASHING MACHINE

CROSS-REFERENCE TO RELATED APPLICATIONS

This application is a National Stage application under 35 U.S.C. § 371 of International Application No. PCT/KR2019/000599, filed on Jan. 15, 2019, which claims the benefit of Korean Application No. 10-2018-0043267, filed on Apr. 13, 2018, Korean Application No. 10-2018-0036520, filed on Mar. 29, 2018, Korean Application No. 10-2018-0018769, filed on Feb. 14, 2018, and Korean Application No. 10-2018-0005234, filed on Jan. 15, 2018. The disclosures of the prior applications are incorporated by reference in their entirety.

TECHNICAL FIELD

The present disclosure relates to a washing machine and, more particularly, to a washing machine having two washing tubs.

BACKGROUND ART

A washing machine is a device that treats laundry through various operations including a washing operation, a spin-drying operation and/or a drying operation. The washing machine is a device that removes contaminants from laundry (hereinafter referred to as "cloth") using water and detergent.

Recently, a washing machine having two washing tubs comes into the market. Such a washing machine is provided with a large-capacity washing tub and a small-capacity washing tub, which are separated from each other. Since the washing tubs may be used at the same time or at different times depending on a user's needs, it is convenient to use. Furthermore, since only the small-capacity washing tub may be used when it is required to wash a small amount of laundry, it is very economical.

However, the conventional washing machine is problematic in that the two washing tubs are completely spatially separated from each other, so that the overall size of a product may be inevitably increased, and two drivers for driving the washing tubs, two water supply mechanisms for supplying water, and two drain mechanisms for draining water are required, so that the cost of products may also be increased.

Korean Patent Laid-Open Publication No. 10-2015-0089344 has disclosed a washing machine in which an auxiliary washing tub is coupled to an upper end of a rotary tub. The auxiliary washing tub has a cylindrical shape, is closed at a bottom thereof, and is open at a top thereof, with drain holes being formed in a circumferential surface of the cylindrical washing tub.

When the auxiliary washing machine is rotated, water moved upwards by centrifugal force is discharged through the holes. However, when it is difficult for the holes to manage a drain quantity, water may undesirably overflow the auxiliary washing tub.

In order to solve such a problem, there is proposed a method in which a cover is installed in the auxiliary washing tub and a flow path for draining is formed in the cover. Particularly, in order to form the flow path, there is proposed a method in which the cover is composed of two upper and lower components and the flow path is formed therebetween. In this case, the two components can be separated from each other for the maintenance of the flow path, but should not be separated from each other during the operation of the washing machine.

DISCLOSURE

Technical Problem

First, the present disclosure is to provide a washing machine including a first washing tub permanently installed in a cabinet, a second washing tub detachably installed in the first washing tub, the second washing tub including a container and a washing-tub cover that covers the container, the washing-tub cover being composed of an assembly made by coupling upper and lower covers to each other, wherein the washing machine includes a slide that may selectively bind or unbind the upper cover to or from the lower cover.

Second, the present disclosure is to provide a washing machine including a second washing tub detachably installed in a first washing tub installed in a cabinet, wherein the second washing tub includes a container containing laundry and water and a washing-tub cover covering the container, and the washing-tub cover is made by coupling upper and lower covers to each other, so that the upper and lower covers can be easily separated from each other for maintenance and repair, but can maintain a firm coupling state so as to prevent the covers from being separated from each other when the washing machine is operated or the second washing tub is moved.

Third, the present disclosure is to provide a washing machine including a first washing tub permanently installed in a cabinet, a second washing tub detachably installed in the first washing tub, the second washing tub including a container and a washing-tub cover that covers the container, the washing-tub cover being composed of an assembly made by coupling upper and lower covers to each other, wherein a handle of the second washing tub is configured to prevent the upper and lower covers from being separated from each other when a user lifts the washing-tub cover.

Technical Solution

A washing machine according to an embodiment of the present disclosure includes a first washing tub rotated about a vertical axis; and a second washing tub detachably coupled to the first washing tub, and rotated integrally with the first washing tub, wherein the second washing tub includes a container containing laundry; a lower cover coupled to a top of the container, and having an inlet into which a water stream moving upwards in the container when the first washing tub rotates is introduced; and an upper cover coupled to a top of the lower cover, and having an opening for putting the laundry into the container, wherein a flow path is provided between the lower cover and the upper cover to discharge the water stream introduced through the inlet to an outside of the second washing tub, and a slide lock is provided on the upper cover, movable between a binding position and an unbinding position, bound to the lower cover in the binding position, and separated from the lower cover in the unbinding position.

The upper cover may include a movement guide slot guiding the slide lock to be movable between the binding position and the unbinding position while engaging with the movement guide slot. The slide lock may include a first slide tab; a second slide tab; and a tab connector connecting the first slide tab and the second slide tab. The tab connector may be located in the movement guide slot, the movement guide slot being disposed between the first slide tab and the second slide tab, and the lower cover may include a binding part interposed between the first slide tab and the second slide tab, when the slide lock is in the binding position. The lower cover may include an avoidance groove in which the first slide tab is located when the slide lock is in the binding position, and a removal groove extending long in a vertical direction and connected at a lower end thereof to the avoidance groove, and the removal groove may be shallower in depth than the avoidance groove, a step being formed between a bottom of the removal groove and a bottom of the avoidance groove. When the slide lock is in the binding position, a portion of an inner surface of the avoidance groove corresponding to the step may interfere with the first slide tab, thus preventing the first slide tab from entering the removal groove. The binding part may form a second gap with the bottom of the avoidance groove, and the first slide tab may be inserted into the second gap, when the slide is in the binding position. A thickness of the binding part may be equal to or more than that of the step.

The upper cover may include a movement guide groove formed to guide a movement of the first slide tab, and the movement guide slot may be formed in the movement guide groove, and a bottom of the movement guide groove may be further interposed between the first slide tab and the second slide tab, when the slide lock is in the binding position.

The lower cover may include a first top portion having a first opening to allow the laundry to pass therethrough, and a first inner-wall portion provided around the first opening, and extending downwards from the first top portion, and the upper cover may include a second top portion having a second opening that communicates with the first opening; and a second inner-wall portion provided around the second opening, and extending downwards from the second top portion, and the avoidance groove and the removal groove may be formed in the first inner-wall portion, and the movement guide slot may be formed in the second inner-wall portion.

The lower cover may include a first top portion having a first opening to allow the laundry to pass therethrough; and a first inner-wall portion provided around the first opening, and extending downwards from the first top portion, the upper cover may include a second top portion having a second opening that communicates with the first opening; and a second inner-wall portion provided around the second opening, and extending downwards from the second top portion, and the slide lock may bind the first inner-wall portion to the second inner-wall portion.

A washing machine according to an embodiment of the present disclosure is configured such that a second washing tub is detachably coupled to a first washing tub rotated about a vertical axis, so that the first and second washing tubs are integrally rotated.

The second washing tub may include a container containing laundry and a washing-tub cover coupled to a top of the container. The washing-tub cover is shaped such that a lower cover and an upper cover are coupled to each other.

A receptor housing is coupled to the lower cover. A slider is provided on the receptor housing. The slider is movable between a binding position and an unbinding position.

The upper cover is provided with a binding tab. When the slider is in the binding position, the binding tab is bound to the slider. By binding force between the slider and the binding tab, separation of the upper cover from the lower cover is prevented.

The lower cover has an inlet into which a water stream moving upwards in the container when the first washing tub rotates is introduced, and an outlet for discharging water introduced through the inlet to an outside of the second washing tub.

The upper cover is coupled to a top of the lower cover, a flow path being defined between the upper cover and the lower cover to extend from the inlet to the outlet.

The receptor housing has an entryway, and an additive receptor receiving an additive is retractably installed in the receptor housing through the entryway.

The receptor housing may include a guide slot guiding the slider to move between the binding position and the unbinding position, in a state where the slider is fitted into the guide slot, and the binding tab may include a catch groove provided on a height corresponding to that of the guide slot and engaging with the slider.

The slider may be separated from the binding tab, when the slider is in the unbinding position.

The slider may include a connecting section moved in the guide slot; an internal section provided inside the receptor housing to be connected to the connecting section; and an external section provided outside the receptor housing to be connected to the connecting section, The connecting section may be provided between the receptor housing and the external section to be connected to the binding tab.

The lower cover may include a movement guide groove into which the external section is inserted, thus guiding a movement of the internal section to correspond to displacement of the slider. A lower end of the movement guide groove may be opened to allow the slider to escape from the movement guide groove in a state where the slider is separated from the binding tab.

A washing machine according to an embodiment of the present disclosure may include a first washing tub rotated about a vertical axis, and a second washing tub detachably coupled to the first washing tub, and rotated integrally with the first washing tub.

The second washing tub may include a container containing laundry, a lower cover coupled to a top of the container, and an upper cover coupled to a top of the lower cover.

The lower cover may have an inlet into which a water stream moving upwards in the container when the first washing tub rotates is introduced, and an outlet for discharging water introduced through the inlet. The upper cover defines a flow path that extends from the inlet to the outlet.

A drawer receiving an additive may be retractably accommodated in the drawer housing, and the drawer housing may be coupled to the lower cover.

A rib extending long in a predetermined direction is formed on any one of the lower cover and the drawer housing, while a slot is formed in the remaining one of the lower cover and the drawer housing to engage with the rib. In the state where the rib and the slot engage with each other, the drawer housing slides along a longitudinal direction of the rib to reach a predetermined assembly position.

The drawer housing is provided with a cover locker. The upper cover may include a binding tab that is bound to the cover locker, when the drawer housing reaches the assembly position.

A washing machine according to an embodiment of the present disclosure may include a first washing tub rotated about a vertical axis; and a second washing tub detachably coupled to the first washing tub and rotated integrally with the first washing tub, wherein the second washing tub may include a container containing laundry; a lower cover coupled to a top of the container and having an internal handle; an upper cover coupled to a top of the lower cover, and including an opening 50*h* for putting laundry into the container, a water supply port into which water that is to be supplied to the container is introduced, and an external handle formed between the opening and the water supply port, The external handle may include a receiving groove that is depressed from a bottom opposite to the internal handle, the internal handle may be inserted into the receiving groove, and a space may be formed under the internal handle to make the opening and the water supply port communicate with each other.

Detailed description of other embodiments is included in the detailed description and the accompanying drawings.

Advantageous Effects

First, a washing machine of the present disclosure is advantageous in that the lower cover and the upper cover are bound or unbound by a simple method of manipulating the slider, so that the upper cover and the lower cover are bound to each other using the slider when the washing machine is operated or the washing-tub cover is lifted, thus ensuring stability and preventing damage, and securing the reliability and stability of a product, and the washing-tub cover can be disassembled for maintenance and repair by simply manipulating the slider, thus enhancing convenience.

Second, a washing machine of the present disclosure is advantageous in that upper and lower covers constituting a washing-tub cover of a second washing tub can be easily separated from each other by a user's simple manipulation.

Third, since a washing-tub cover can be simply disassembled, it is easy to maintain and repair the washing-tub cover.

Fourth, even if a user does not directly bind the upper cover to the lower cover, the upper cover and the lower cover are automatically bound while an additive receptor is located in place.

Fifth, upper and lower covers constituting a washing-tub cover of a second washing tub can be easily separated from each other by a user's simple manipulation.

Sixth, since a washing-tub cover can be simply disassembled, it is easy to maintain and repair the washing-tub cover.

Seventh, even if a user does not directly bind the upper cover to the lower cover, the upper cover and the lower cover are automatically bound while a drawer is located in place.

The present disclosure is not limited to the above-described effects, and other effects that are not mentioned will be clearly understood by those skilled in the art from the attached claims.

A washing machine of the present disclosure is advantageous in that, when a user lifts a second washing tub, he or she holds both an external handle of an upper cover and an internal handle of a lower cover, thus preventing the upper cover and the lower cover from being separated from each other.

MODE FOR DISCLOSURE

Figure 1:
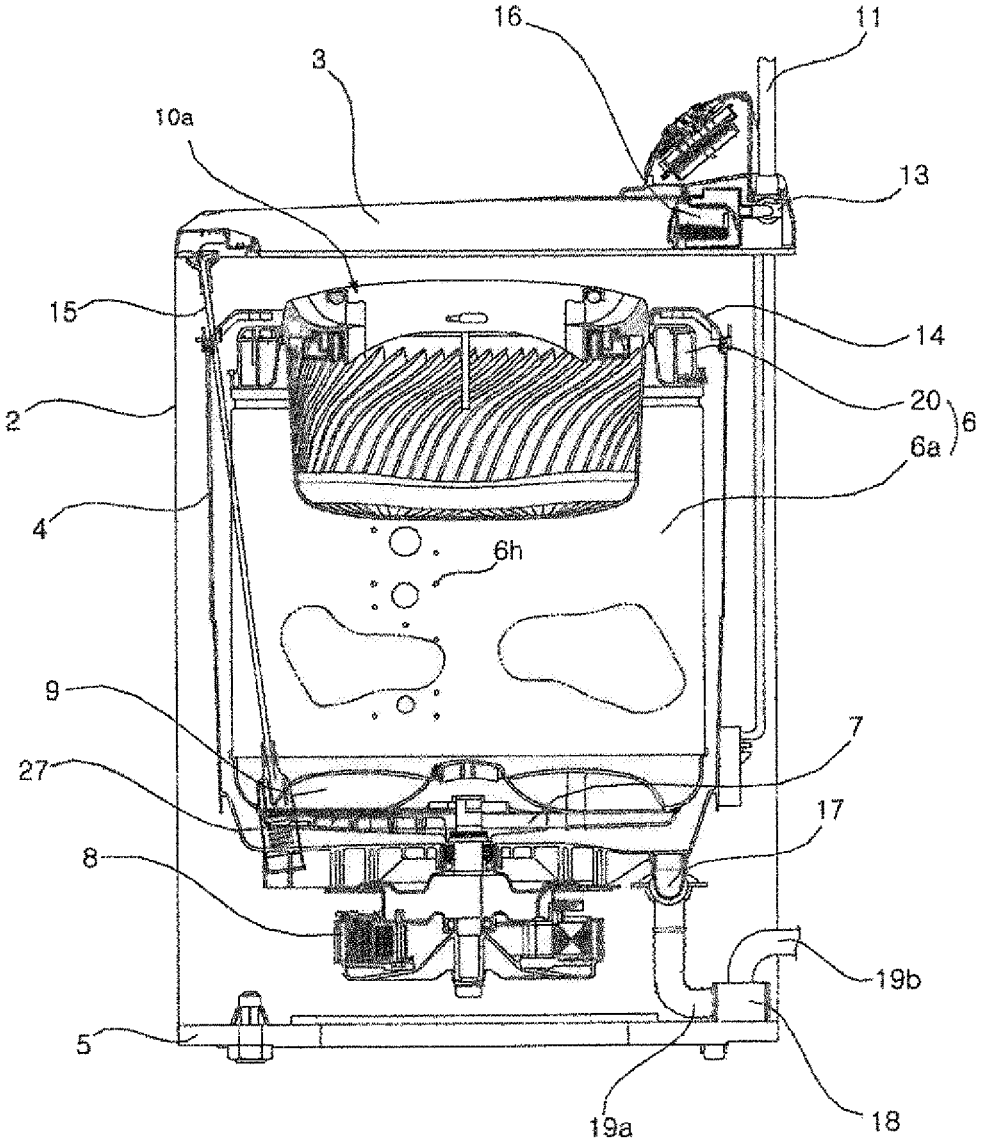
FIG. 1 is a side sectional view of a washing machine in accordance with an embodiment of the present disclosure.

The above and other objectives, features, and other advantages of the present invention will be more clearly understood from the following detailed description when taken in conjoint with the accompanying drawings. However, the present disclosure may be embodied in other aspects without being limited to the embodiments disclosed below. The embodiments are provided to make the present disclosure complete and to sufficiently convey the scope of the present disclosure to those skilled in the art without departing from the scope of the claims. In the present specification, it should be noted that the same reference numerals are used to denote the same components throughout different drawings.

Figure 2:
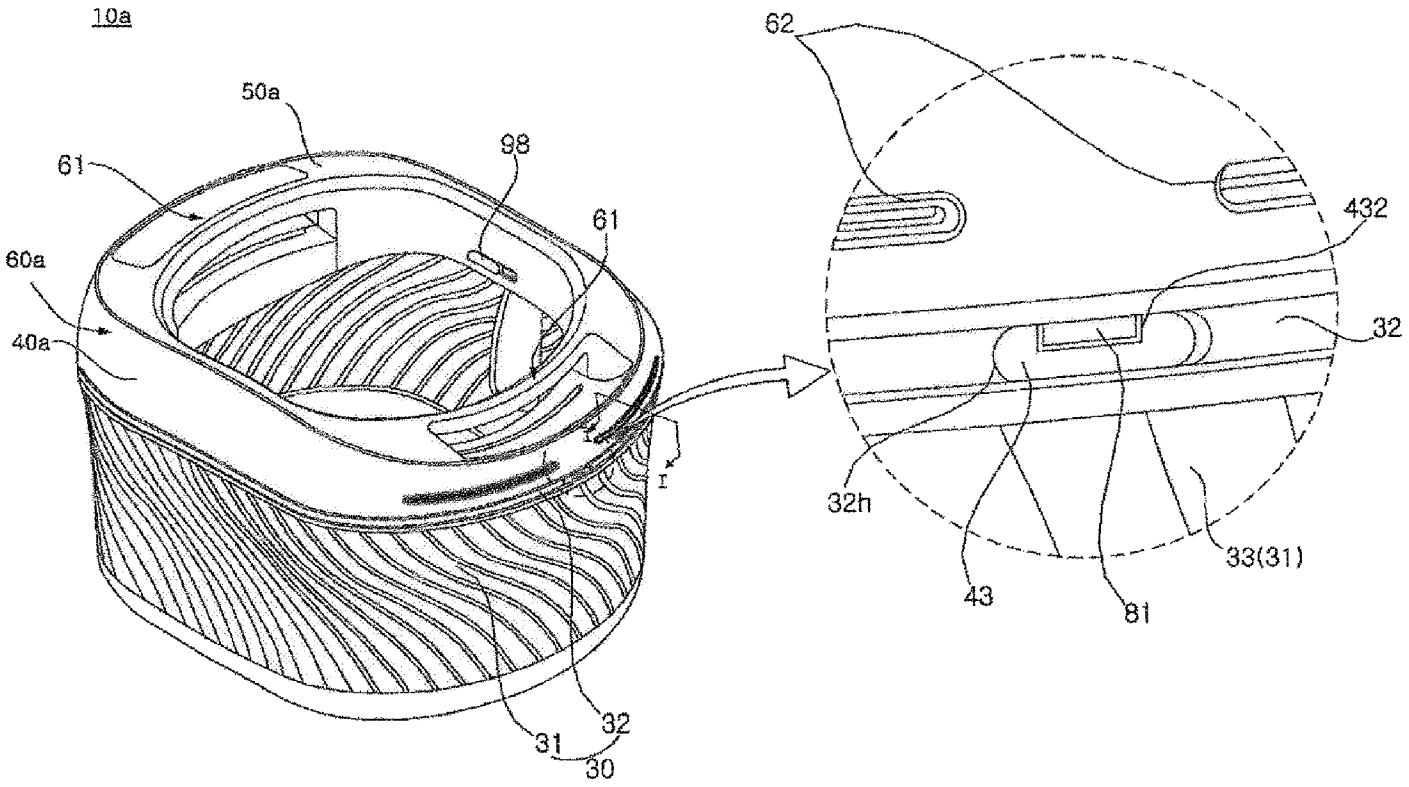
FIG. 2 is a perspective view of a second washing tub in accordance with a first embodiment.
Figure 3:
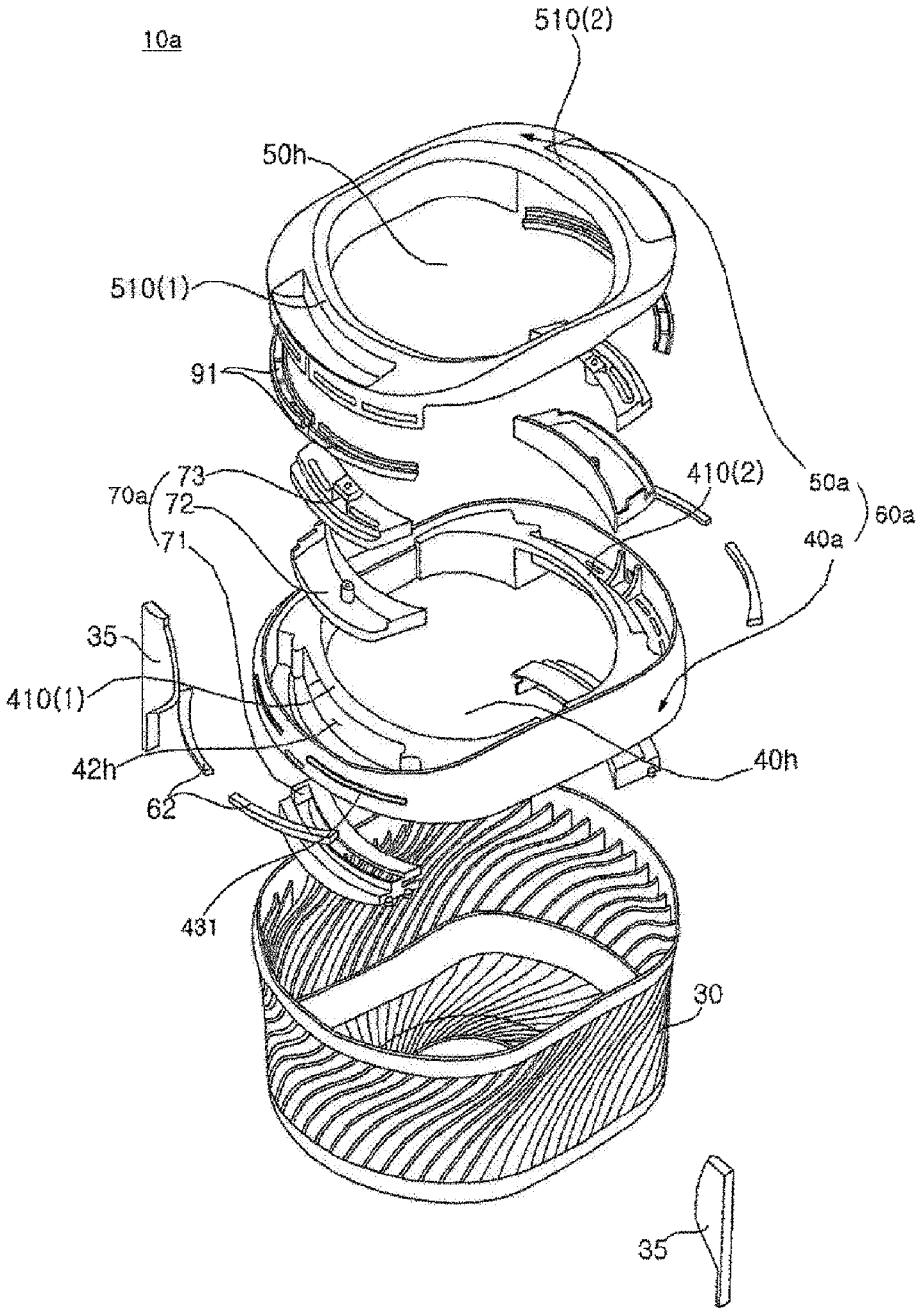
FIG. 3 is an exploded perspective view of the second washing tub illustrated in FIG. 2.
Figure 4:
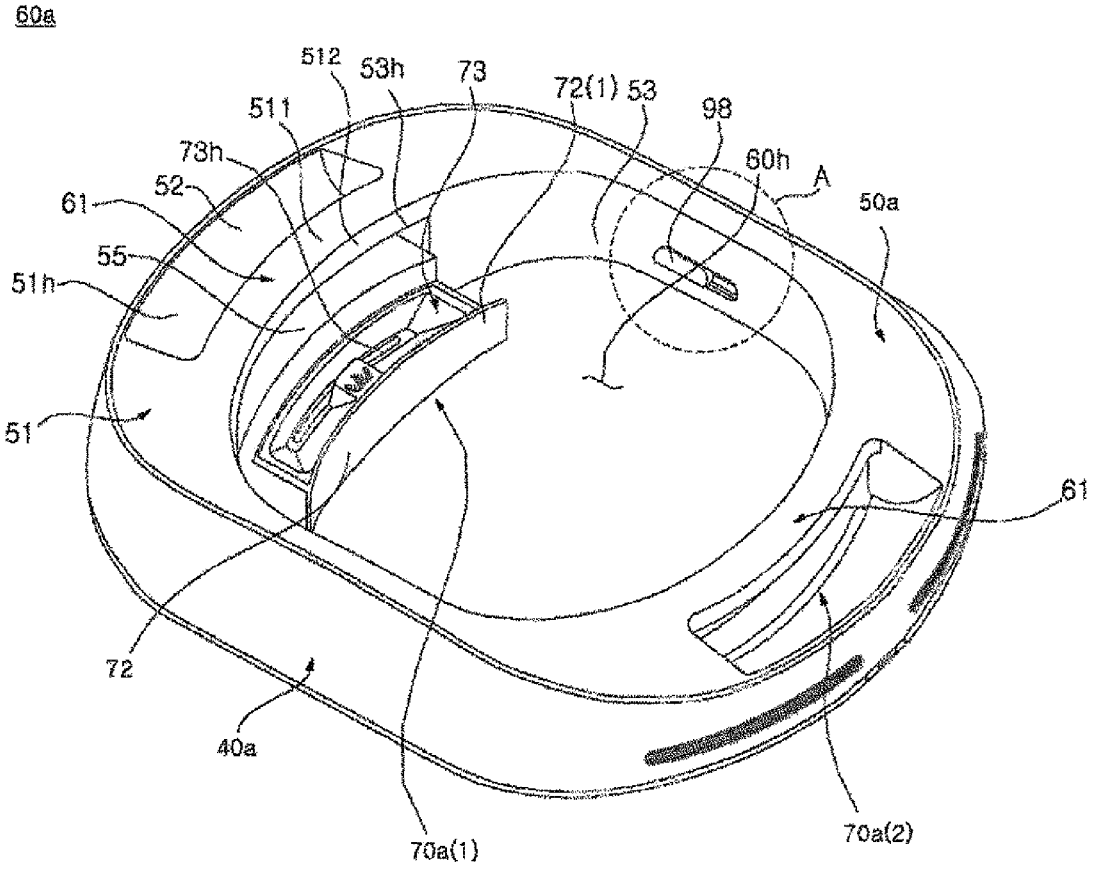
FIG. 4 is a perspective view illustrating a washing-tub cover illustrated in FIG. 2.
Figure 5:
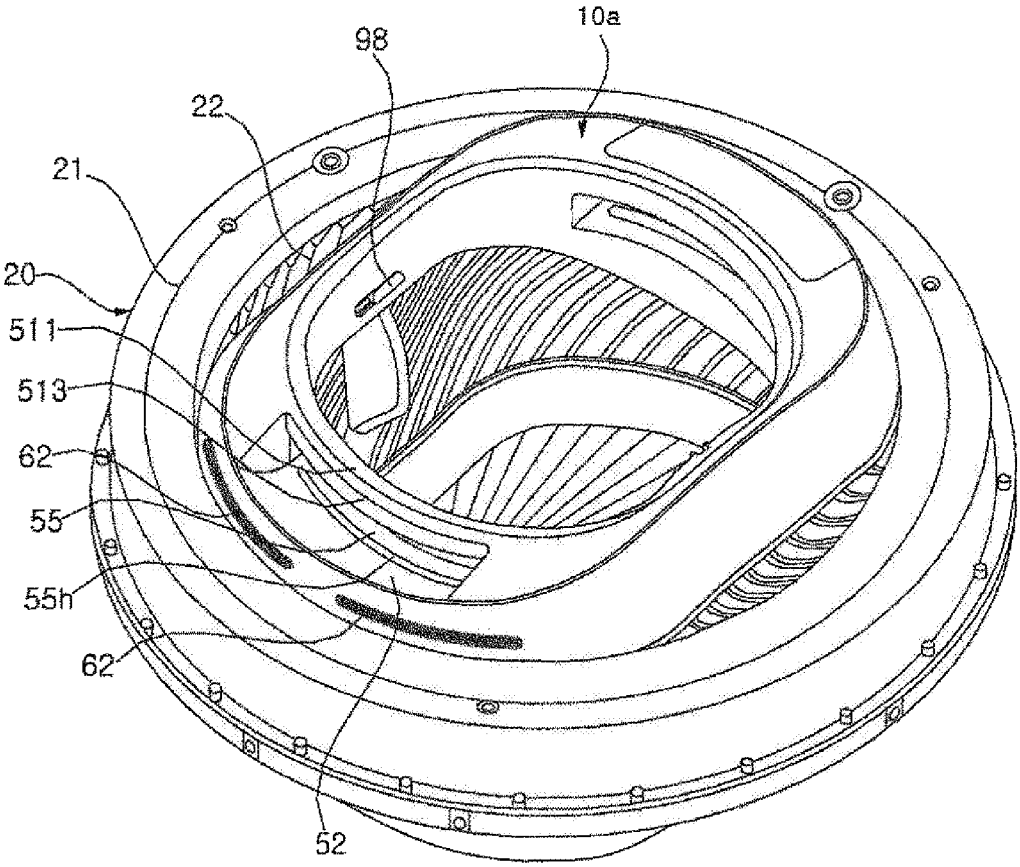
FIG. 5 is a perspective view illustrating a state in which the second washing tub illustrated in FIG. 2 is installed in a balancer.
Figure 6:
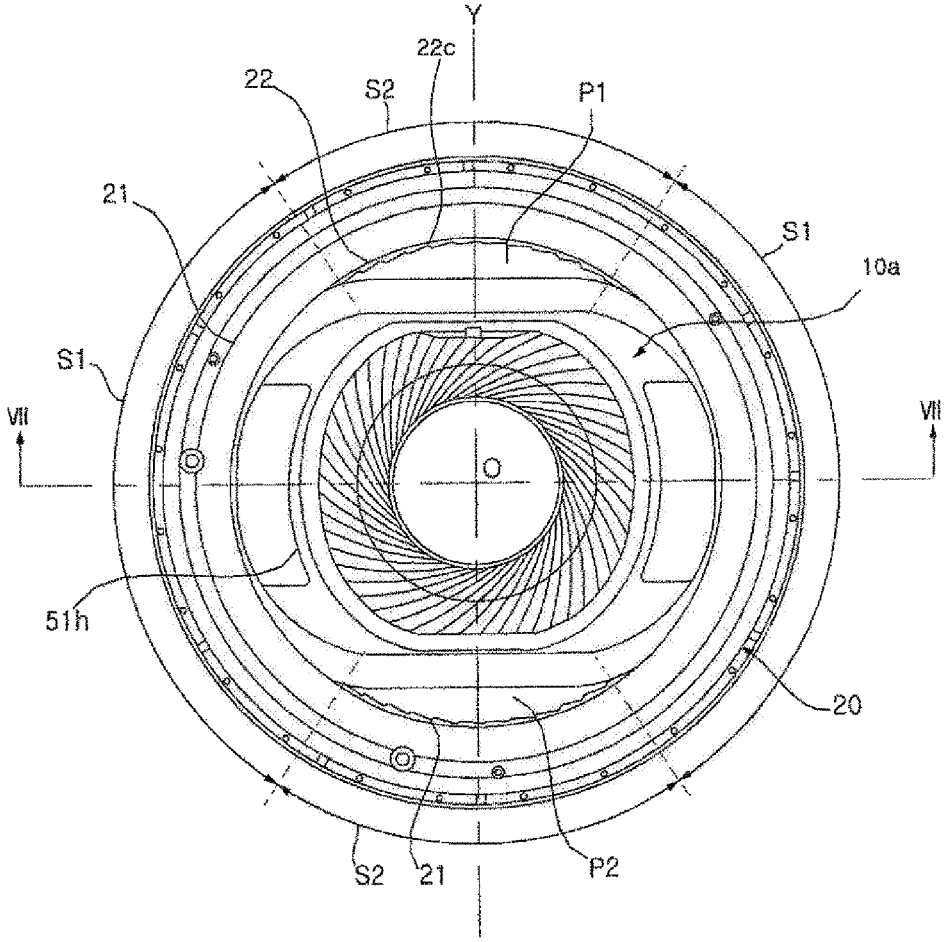
FIG. 6 is a top view of an assembly illustrated in FIG. 5.
Figure 7:
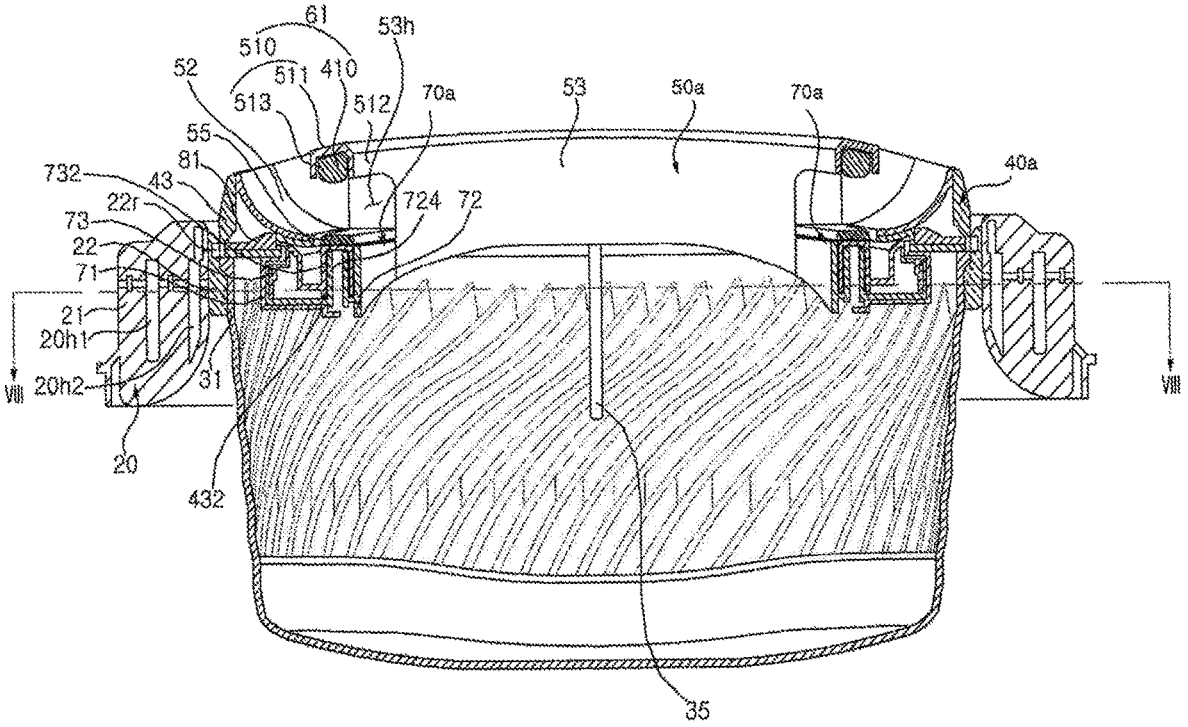
FIG. 7 is a sectional view taken along line VII-VII of FIG. 6.
Figure 8:
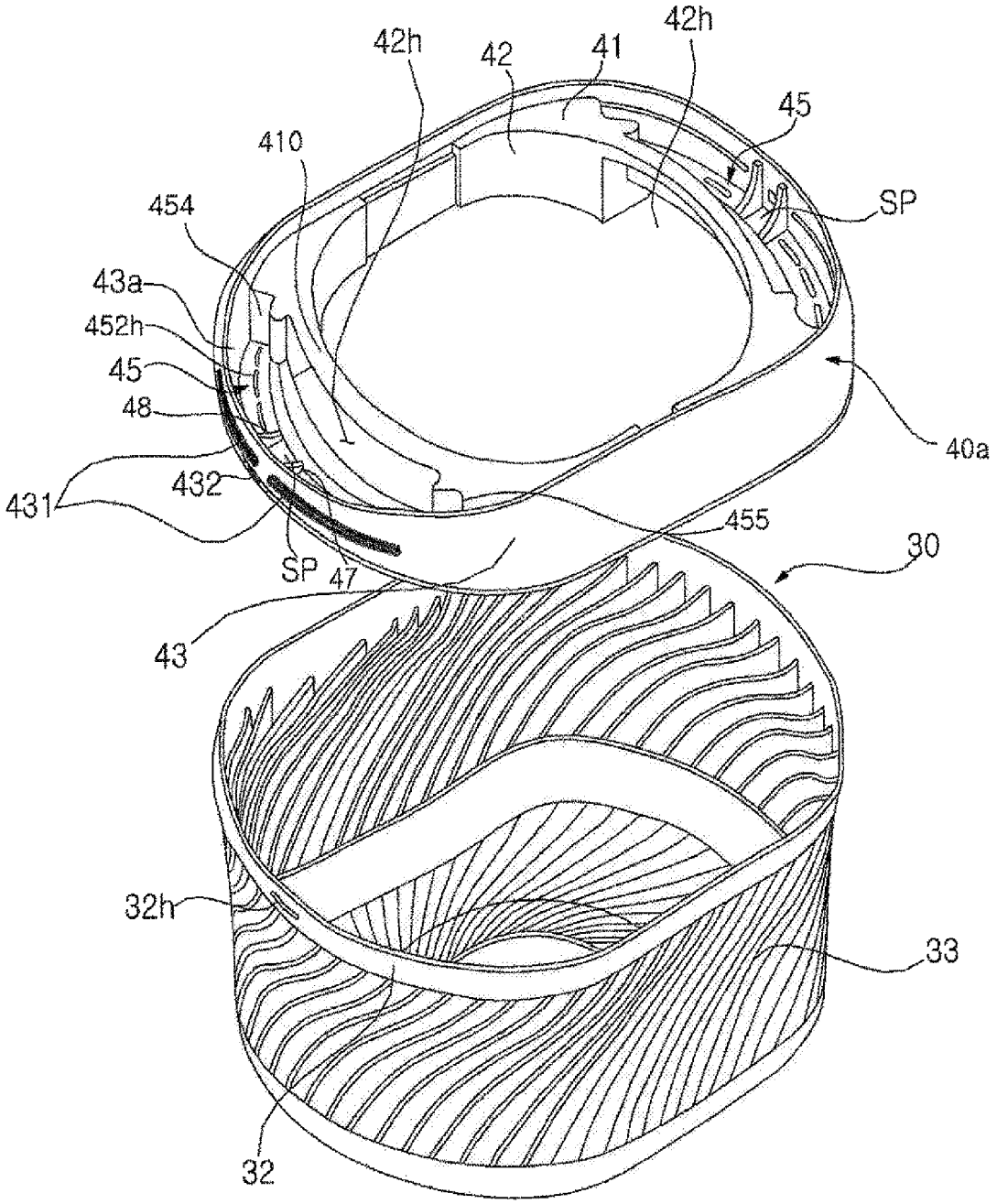
FIG. 8 illustrates a state in which an upper cover and a container of the second washing tub in accordance with the first embodiment are separated from each other.
Figure 9:
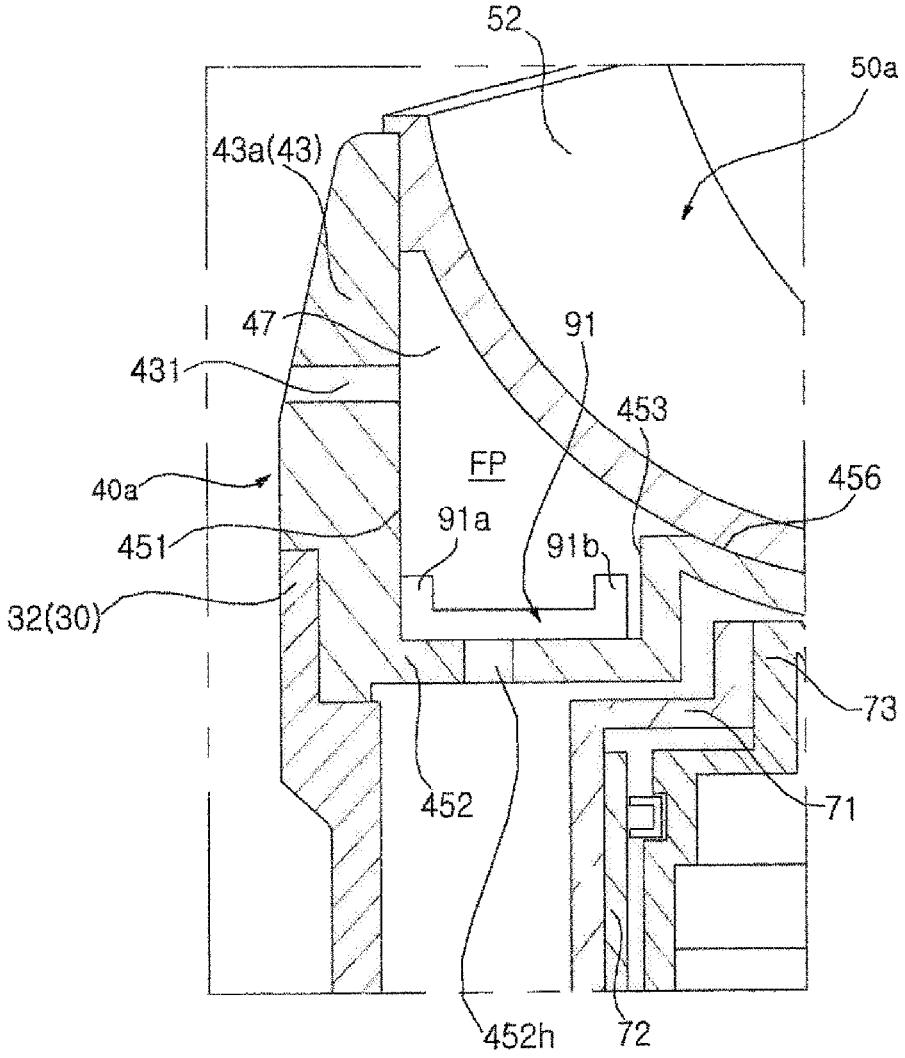
FIG. 9 is a sectional view taken along line I-I of FIG. 2.

FIG. 1 is a side sectional view of a washing machine in accordance with an embodiment of the present disclosure. FIG. 2 is a perspective view of a second washing tub in accordance with a first embodiment. FIG. 3 is an exploded perspective view of the second washing tub illustrated in FIG. 2. FIG. 4 is a perspective view illustrating a washing-tub cover illustrated in FIG. 2. FIG. 5 is a perspective view illustrating a state in which the second washing tub illustrated in FIG. 2 is installed in a balancer. FIG. 6 is a top view of an assembly illustrated in FIG. 5. FIG. 7 is a sectional view taken along line VII-VII of FIG. 6. FIG. 8 illustrates a state in which an upper cover and a container of the second washing tub in accordance with the first embodiment are separated from each other. FIG. 9 is a sectional view taken along line I-I of FIG. 2.

Referring to FIGS. 1 to 9, a cabinet 2 defines an appearance of a washing machine, and forms a space in which a water storage tub 4 is accommodated. The cabinet 2 is supported by a flat cabinet base 5, includes a front surface, a left surface, a right surface, and a rear surface, and is opened at a top thereof.

A top cover 3 may be coupled to the open top of the cabinet 2. An opening may be formed in the top cover 3 to put or take laundry (or "cloth") into or out from the cabinet. A door (not shown) may be rotatably coupled to the top cover 3 to open or close the opening.

The water storage tub 4 contains water therein, and may be suspended in the cabinet 2 by a support rod 15. The support rod 15 may be provided on each of four corners of the cabinet 2. A first end of the support rod 15 is pivotably connected to the top cover 3, and a second end thereof is connected to the water storage tub 4 by a suspension 27 that absorbs vibration.

The water storage tub 4 may be opened at a top thereof, and a water-storage-tub cover 14 may be provided on the open top. The water-storage-tub cover 14 has a ring shape in which an approximately circular opening is formed in a central portion thereof, so that the laundry is put into the water storage tub through the opening.

In the water storage tub 4, a first washing tub 6 may be disposed to receive the laundry and rotate about a vertical axis. The vertical axis is substantially perpendicular to the ground. Although the vertical axis may be precisely aligned with a line perpendicular to the ground, it may form a predetermined angle with the vertical line without being limited thereto. A plurality of holes 6*h* is formed in the first washing tub 6 to allow water to pass therethrough, and water flows through the holes 6*h* between the first washing tub 6 and the water storage tub 4.

The first washing tub 6 may include a drum 6*a* that is opened at a top thereof, with the holes 6*h* being formed therein, and a ring-shaped balancer 20 that is coupled to the top of the drum 6*a*. A bottom of the drum 6*a* may be connected to a rotating shaft of a driver 8 by a hub 7.

A pulsator 9 may be rotatably provided in a lower portion of the first washing tub 6. The pulsator 9 may include a plurality of radial blades that protrude upwards. When the pulsator 9 is rotated, a water stream is created by the blades.

The balancer 20 compensates for eccentricity caused by the rotation of the drum 6*a*. The balancer 20 is coupled to an upper end of the drum 6*a*. The balancer 20 may include a balancer body 21 that forms ring-shaped cavities 20*h*1 and 20*h*2 (see FIG. 7). Fluid (e.g. salt water) or a plurality of weights (e.g. metal spheres) may be inserted into the cavities 20*h*1 and 20*h*2. A plurality of annular cavities 20*h*1 and 20*h*2 may be formed to be concentric or have different diameters.

If the drum 6*a* is biased to one side during its rotation, the fluid or the weights are moved in a direction opposite to the biased direction of the drum 6*a* to correct eccentricity. Since various types of ring-shaped balancers 20 that are applied to the washing machine are already known to those skilled in the art, a detailed description thereof will be omitted.

10*a*, 60*a*, 40*a*, 50*a*, 70*a*

The second washing tub 10*a* may be inserted into a space (or approximately circular opening) defined by the ring-shaped balancer 20, and may be supported by the balancer 20 in the inserted state. The second washing tub 10*a* includes a container 30 that contains laundry, and a washing-tub cover 60*a* that covers the container 30. The container 30 contains laundry and water and is opened at a top thereof. At least a portion of the opened top is covered by the washing-tub cover 60*a*. The container 30 may be made of a transparent material so that the laundry contained therein may be seen from an outside.

A ring-shaped support 22 may be formed on an inner-diameter portion of the balancer body 21 (a portion forming an inner circle among two circles forming the ring shape when viewed from above) to support the container 30. A plurality of engagement grooves 22*c* extending in a vertical direction is arranged on the support 22 along a circumferential direction. Each engagement groove 22*c* may have a helical shape.

Projection-shaped threads 33 (see FIG. 8) may be formed on an outer surface of the container 30 to engage with the engagement grooves 22*c* formed in the support 22. The threads 33 extend vertically in a shape corresponding to the engagement grooves 22*c*. In other words, when the engagement groove 22*c* has the helical shape, the thread 33 is also the projection that extends helically. A plurality of threads 33 is arranged in the circumferential direction.

The threads 33 form a kind of helical gear to engage with the engagement grooves 22*c* formed in a seat 33 of the balancer 20. Due to such a structure, when the first washing tub 6 is rotated, the second washing tub 10*a* may be rotated integrally with the first washing tub 6 without running idle.

Furthermore, since the balancer 20 and the container 30 are coupled in a screw-type fastening method, the coupling of the second washing tub 10*a* and the first washing tub 6 is reliably maintained. Particularly, the second washing tub 10*a* may be fixed without moving downwards by binding force (e.g. frictional force acting between surfaces that engage with each other) generated by coupling between the threads 33 and the engagement grooves 22*c*.

The second washing tub 10*a* contains laundry, and is removably provided in the first washing tub 6. That is, the second washing tub 10*a* is detachably coupled to the first washing tub 6. If the first washing tub 6 is rotated in a state in which the second washing tub 10*a* is installed, the second washing tub 10*a* is also rotated integrally with the first washing tub 6.

A user may put first laundry into the first washing tub 6 in a state where the second washing tub 10*a* is not installed, or may install the second washing tub 10*a* and then put second laundry into the second washing tub 10*a*.

Referring to FIG. 1, the driver 8 may be disposed in the cabinet 2 to provide power for rotating the first washing tub 6 and the pulsator 9. The driver 8 may be disposed under the water storage tub 4, and be suspended in the cabinet 2 while being coupled to a bottom of the water storage tub 4.

The rotating shaft of the driver 8 may be always connected to the pulsator 9, and be connected or disconnected to or from the first washing tub 6 by the conversion of a clutch (not shown). Therefore, when the driver 8 is operated with its rotating shaft being connected to the first washing tub 6, the pulsator 9 and the first washing tub 6 are integrally rotated. When the rotating shaft is operated while being disconnected (or separated) from the first washing tub 6, the first washing tub 6 is stopped and only the pulsator 9 is rotated.

The driver 8 may include a washing motor capable of controlling speed. The washing motor may be an inverter direct drive motor. A controller (not shown) may include a Proportional-Integral controller (PI controller), a Proportional-Integral-Derivative controller (PID controller), etc. An output value (e.g. output current) of the washing motor is input into the controller. Based on the output value, the controller may control such that the rpm (or rotating speed) of the washing motor follows preset target rpm (or target rotating speed).

The controller may control the overall operation of the washing machine as well as the washing motor. It will be understood that each of components mentioned below is controlled by the control of the controller.

Meanwhile, the washing machine may include at least one water supply pipe 11 that guides water supplied from an external water source such as a faucet. At least one water supply pipe 11 may include a cold-water pipe (not shown) that receives cold water from the external water source, and a hot-water pipe (not shown) that receives hot water therefrom.

A water supply valve 13 may be provided to control the water supply pipe 11. If a plurality of water supply pipes 11 is provided, a plurality of water supply valves 13 is likewise provided, so that the water supply pipes 11 may be controlled, respectively, by the water supply valves 13. If at least one water supply valve 13 is opened under the control of the controller, water is supplied through the opened water supply valve 13 and the corresponding water supply pipe 11 to a main dispenser 16.

The main dispenser 16 supplies an additive acting on laundry through the water supply pipe 11 to the water storage tub 4, along with the supplied water. The additive supplied by the main dispenser 16 includes a washing detergent, a fabric softener, bleach, etc.

Meanwhile, the washing machine may further include a drain bellows 19*a* that discharges water from the water storage tub 4, and a drain valve 17 that controls the drain bellows 19*a*. The drain bellows 19*a* may be connected to a pump 18. When the drain valve 17 is opened, water is supplied through the drain bellows 19*a* to the pump 18. As such, when the pump 18 is operated, water introduced into the pump 18 is discharged through a drain pipe 19*b* to an outside of the washing machine.

A laundry feed opening 60*h* (see FIG. 4) is formed in a central portion of the washing-tub cover 60*a* to put laundry into the container 30. The washing-tub cover 60*a* may include a lower cover 40*a*, and an upper cover 50*a* coupled to a top of the lower cover 40*a*. The lower cover 40*a* may be coupled to the upper end of the container 30. The lower cover 40*a* and the container 30 may be made of synthetic resin, and be coupled to each other preferably by bonding, more preferably by thermal bonding. However, the present disclosure is not limited thereto.

The upper cover 50*a* and the lower cover 40*a* may be detachably coupled to each other. A first opening 40*h* is formed in the lower cover 40*a*, while a second opening 50*h* is formed in the upper cover 50*a* to communicate with the first opening 40*h* and define the laundry feed opening 60*h*.

A space in which a locking member 81 (see FIG. 7), a check valve 91 (see FIG. 9), etc. that will be described below are disposed is provided between the upper cover 50*a* and the lower cover 40*a*. When necessary, a user may separate the upper cover 50*a* from the lower cover 40*a*, so that it is possible to maintain or repair the locking member 81 or the check valve 91 and to clean a flow path formed between the upper cover 50*a* and the lower cover 40*a*. Here, the flow path guides water introduced through an inlet 452*h* that will be described below to discharge the water to an outside of the washing-tub cover 60*a*. In an embodiment, a space for guiding the water stream from the inlet 452*h* to an outlet 431 is defined by the upper cover 50*a* and the lower cover 40*a*. However, the present disclosure is not limited thereto, and a separate member for creating the flow path may be provided between the upper cover 50*a* and the lower cover 40*a*.

A water supply port 51*h* (see FIG. 4) may be formed in the washing-tub cover 60*a* to introduce water that is discharged from the main dispenser 16. A sub dispenser 70*a* is provided in the washing-tub cover 60*a* to contain the additive such as the detergent, the bleach or the fabric softener, and water supplied to the water supply port 51*h* is supplied to the container 30 along with the additive while passing through a sub dispenser 70*a*. The additive is preferably liquid to be smoothly discharged through a siphon pipe 724 (see FIG. 7) that will be described below.

Water may be supplied multiple times through the water supply port 51*h*. In this case, since all the additive is discharged through the siphon pipe 724 during a first water supply operation, water (or raw water) in which the additive is not dissolved is supplied through the sub dispenser 70*a* during a subsequent water supply operation.

Meanwhile, if the second washing tub 10*a* is rotated at sufficient speed, a water stream developed to an outside in a radial direction by the centrifugal force in the container 30 may move upwards along an inner surface of the container 30 (i.e. inner surface of a container body 31) to be introduced into the washing-tub cover 60*a* through the inlet 452*h* that will be described below.

The washing-tub cover 60*a* may include a nozzle 62 (see FIGS. 2 and 3) that discharges the water stream guided along the flow path FP (see FIG. 9) to the outside of the washing-tub cover 60*a*. The nozzle 62 may be fixedly inserted into the outlet 431 (see FIGS. 3 and 9) formed in the lower cover 40*a*. The nozzle 62 may be provided with a slit-shaped exit extending long in a horizontal direction.

The exit is opened towards a side lower than the water-storage-tub cover 14. The second washing tub 10*a* is rotated at high speeds, so that water discharged through the nozzle 62 may be guided along the bottom of the water-storage-tub cover 14.

As illustrated in FIG. 5, in a state where the second washing tub 10*a* is installed in the balancer 20, the nozzle 62 is located above the balancer 20 (i.e. exposed above the balancer 20), so that water sprayed through the nozzle 62 may reach the water storage tub 4 without interfering with the balancer 20.

Meanwhile, referring to FIG. 3, a vane 35 may be provided on the inner surface of the container 30 to extend long in a vertical direction. The vane 35 protrudes from the inner surface of the container 30. The vane may be manufactured separately from the container 30, and then installed in the container 30. After the water stream generated by the rotation of the second washing tub 10*a* is moved upwards by collision with the vane 35, the water stream drops to the central portion of the container 30. A plurality of vanes 35 may be provided. Preferably, the plurality of vanes is disposed to be symmetrical with respect to the rotation center of the second washing tub 10*a*. In an embodiment, a pair of vanes 35 is provided, but the number of the vanes 35 should not be limited thereto.

The washing-tub cover 60*a* may include a handle 61 formed around the laundry feed opening 60*h*. When seeing the washing-tub cover 60*a* from top to bottom, the laundry feed opening 60*h* is located on a first side of the handle 61, and the water supply port 51*h* is located on a second side thereof. The handles 61 may be provided on both sides of the laundry feed opening 60*h*, respectively, and the water supply port 51*h* may be likewise provided on the second side of each handle 61.

The sub dispensers 70*a* may be provided on both sides of the washing-tub cover 60*a*, respectively. In this case, the washing detergent or the bleach may be supplied through any one of the pair of sub dispensers 70*a*, while the fabric softener may be supplied through the other sub dispenser.

The sub dispenser 70*a* may be provided on the lower cover 40*a*. The sub dispensers 70*a* may be disposed at positions corresponding to a pair of water supply ports 51*h*, respectively. Hereinafter, the pair of sub dispensers 70*a* are divided into a first sub dispenser 70*a*(1) and a second sub dispenser 70*a*(2).

Depending on the rotation position (or rotation angle) of the second washing tub 10*a*, water discharged from the main dispenser 16 may be selectively supplied to the first sub dispenser 70*a*(1) or the second dispenser 70*a*(2). For example, the rotation position (or rotation angle) of the second washing tub 10*a* may be controlled by the controller so that water is supplied to the first sub dispenser 70*a*(1) in a wash cycle, and water is supplied to the second sub dispenser 70*a*(2) in a rinse cycle.

Each sub dispenser 70*a* may include a dispenser housing 71, a drawer 72 that is retractably received in the dispenser housing 71 and is opened at a top thereof, and a drawer cover 73 that covers the opened top of the drawer 72. The drawer cover 73 may be detachably coupled to the drawer 72. An opening 73*h* through which water discharged from the main dispenser 16 passes is formed in the drawer cover 73, so that water passing through the opening 73*h* is fed into the drawer 72.

The upper cover 50*a* may include a flow guide 52 that guides water introduced through the inlet 51*h* to the sub dispenser 70*a*. The flow guide 52 has an inclined surface to guide water downwards, and water guided along the inclined surface is guided to the opening 73*h* of the drawer cover 73.

A plate 55 may be provided in the upper housing 50*a* to be fixed to an upper side of the sub dispenser 70*a*. The plate 55 may be removably attached to the upper housing 50*a*. A gap 55*h* (see FIG. 5) is formed between the plate 55 and a lower end of the flow guide 52, and water guided along the flow guide 52 passes through the gap 55*h* to be supplied to the opening 73*h* of the drawer cover 73.

The dispenser housing 71 may provide a space in which the drawer 72 is accommodated, and may be coupled to the lower cover 40*a*. The dispenser housing 71 may be fastened to the lower cover 40*a* by a fastening member such as a screw or a bolt.

The drawer 72 may be a container opened at a top thereof, and the additive may be contained in the drawer 72. The drawer 72 is coupled to the dispenser housing 71. Such a coupling allows the drawer 72 to be inserted into the dispenser housing 71 or to be taken out from the dispenser housing 71. In an embodiment, the drawer 72 is slidably coupled to the dispenser housing 71. However, the present disclosure is not limited thereto. For example, the drawer may be pivotably coupled to the dispenser housing 71, namely, may be hinged to the dispenser housing 71.

Referring to FIG. 7, the drawer 72 may include the siphon pipe 724 that protrudes upwards from the bottom, and the drawer cover 73 may include a siphon cap 732 that covers the siphon pipe 724.

The exit of the siphon pipe 724 is formed in the bottom of the drawer 72, and a flow path having an annular cross-section is formed between the siphon cap 73 and an outer circumferential surface of the siphon pipe 724. Such a structure is suitable to supply the liquid additive.

If water is supplied to the sub dispenser 70*a* and thus a water level in the drawer 72 rises gradually, water moves upwards along the flow path having the annular cross-section and thus flows through an entrance of an upper end of the siphon pipe 724 into the siphon pipe 724. Subsequently, the water is discharged through the exit of a lower end of the siphon pipe 724 to the container 30.

Meanwhile, in order to simultaneously wash the laundry in the first washing tub 6 and the laundry in the second washing tub 10*a*, water should be supplied to the first washing tub 6 in a state where the second washing tub 10*a* is installed. Hereinafter, a method of supplying water to the first washing tub 6 in a state where the second washing tub 10*a* is installed will be described.

Referring to FIG. 6, when viewed from above, the appearance of the second washing tub 10*a* may include a first section 51 that is in contact with the support 22 of the balancer 20, and a second section S2 that is spaced apart from the support 22.

The first section 51 may be located on a first axis (line shown by VII-VII) that passes through a vertical axis O, and the second section S2 may be located on a second axis Y that passes through the vertical axis O and is perpendicular to the first axis. The first sections 51 may be formed on both sides to be symmetrical with respect to the second axis Y, while the second sections S2 may be formed on both sides to be symmetrical with respect to the first axis.

When the second washing tub 10*a* is rotated to be aligned in a first rotation position by controlling the driver 8 with the controller, water discharged from the main dispenser 16 may be supplied into the container 30 through gaps P1 and P2 formed between the second sections S2 and the inner circumferential surface of the balancer 20.

When the second washing tub 10*a* is rotated at a predetermined angle from the first rotation position to be aligned in a second rotation position by controlling the driver 8 with the controller, water discharged from the main dispenser 16 is supplied through the water supply port 51*h* to the sub dispenser 70*a*. That is, when the second washing tub 10*a* is in the second rotation position, the water supply port 51*h* is aligned with the exit of the main dispenser 16, so that the water discharged through the exit is introduced into the water supply port 51*h*. In an embodiment, the second rotation position is a position where the first washing tub 6 is rotated by 90 degrees from the first rotation position. However, when the position of the water supply port 51*h* is changed according to an embodiment, an angle between the second rotation position and the first rotation position may be changed. As described above, since the washing motor may control speed, the controller may control the rotation angle of the first washing tub 6 or the rotation position of the first washing tub 6, based on the speed of the washing motor. Since the second washing tub 10*a* is rotated integrally with the first washing tub 6, the control of the rotation angle or the rotation position of the first washing tub 6 leads to the control of the rotation angle or the rotation position of the second washing tub 10*a*.

To be more specific, a first hall sensor (not shown) may be provided on the water-storage-tub cover 14, and a first magnet may be provided on the second washing tub 10*a*. During the rotation of the second washing tub 10*a*, the first hall sensor may be configured to sense a magnetic field generated by the first magnet and to send a signal to the controller on the basis of the sensed magnetic field. The controller may identify the rotation speed, the rotation position (or position of the first magnet), and the rotation angle of the second washing tub 10*a* on the basis of the received signal, and may control the washing motor so that the first washing tub 6 is aligned in the first rotation position or the second rotation position on the basis of the identified value.

Meanwhile, the second magnet may be provided on a rotor of the washing motor, and a second hall sensor may be disposed on a fixed structure (e.g. bottom of the water storage tub 4) in the vicinity of the second magnet that senses the magnetic field generated by the second magnet. A plurality of second magnets may be disposed along the periphery of the rotor. The controller may control the washing motor on the basis of the signal output from the second hall sensor. Here, by considering the signal output from the above-described first hall sensor together, the second washing tub 10*a* may be controlled to be aligned in the first rotation position or the second rotation position.

According to an embodiment, the rotation angle of the rotor may be sensed without a separate sensor. In other words, the controller may sense the rotation angle of the rotor in a sensorless method. For example, after the phase current of a predetermined frequency flows through the washing motor, the position of the rotor of the washing motor may be estimated on the basis of the output current that is detected while the current of the predetermined frequency flows through the washing motor. Since such a sensorless method is known to those skilled in the art, a detailed description thereof will be omitted.

Meanwhile, after water has been supplied into the container 30, the controller controls the driver 8 according to a preset algorithm to perform a washing operation. Subsequently, water used for washing laundry should be discharged from the second washing tub 10*a*. The drainage is performed using the centrifugal force caused by the high-speed rotation of the second washing tub 10*a*.

To be more specific, referring to FIGS. 3, 8 to 9, the inlet 452*h* and the outlet 431 are formed in the lower cover 40*a*. The water stream moved upwards in the container 30 by the centrifugal force when the second washing tub 10*a* rotates is introduced into the inlet, and the water introduced through the inlet 452*h* is discharged through the outlet 431. As illustrated in FIG. 2, the nozzle 62 may be inserted into the outlet 431.

The lower cover 40*a* may include a bottom portion 452 into which the inlet 452*h* is formed, and a sidewall portion 43*a* which extends upwards from the bottom portion 452 and in which the outlet 431 is formed. The lower cover 40*a* may include a first top portion 41 into which the first opening 40*h* is formed, a first inner-wall portion 42 extending downwards from the first top portion 41 around the first opening 40*h*, and an outer-wall portion 43 extending along an outer periphery of the first top portion 41.

A portion of the first top portion 41 is depressed to form a groove 45. In this case, the bottom portion 452 forms the bottom surface of the groove 45. The sidewall portion 43*a* belongs to the outer-wall portion 43, and forms an external inner circumferential surface 451 of the groove 45. The opening 42*h* may be formed in the first inner-wall portion 42 to install the dispenser 70*a* therein.

Referring to FIGS. 7 to 9, the lower cover 40*a* may include an internal handle 410 formed between the groove 45 and the first opening 40*h*. A first side surface of the internal handle 410 may be formed by the first inner-wall portion 42. In this case, the first side surface defines the first opening 40*h*. The opening 42*h* for installing the dispenser 70*a* is formed in the first side surface, and the opening 42*h* is formed to be higher than the dispenser 70*a*, so that a space is formed between the dispenser 70*a* and the internal handle 410 to allow a user's finger to pass therethrough when the user grips the handle 61.

Meanwhile, the groove 45 has an internal inner circumferential surface 453 that is formed to be radially spaced apart from the external inner circumferential surface 451. The internal inner circumferential surface 453 is located opposite to the external inner circumferential surface 451, and extends upwards from the bottom of the groove 45.

Both ends of the internal inner circumferential surface 453 are connected to the external inner circumferential surface 451 by groove inner surfaces 454 and 455 (see FIG. 8), and thus an inside surrounded by the internal inner circumferential surface 453, the first groove inner surface 454, the second groove inner surface 455, and the external inner circumferential surface 451 is an area defined by the groove 45.

The inclined surface 456 may extend inwards in the radial direction from the upper end of the internal inner circumferential surface 453. In order to prevent water from penetrating a gap between the inclined surface 456 and the flow guide 52 of the upper cover 50*a*, the inclined surface 456 is preferably in contact with the bottom of the flow guide 52.

The internal inner circumferential surface 453 is connected to the outer-wall portion 43 by a pair of partition walls 47 and 48. The locking member 81 that will be described below is preferably in contact with the internal inner circumferential surface 453 by the restoring force of a spring (not shown) in an unlock position (i.e. position of the locking member 81 when the second washing tub 10*a* is stopped).

The upper cover 50*a* may include a second top portion 51 in which the second opening 50*h* and the water supply port 51*h* are formed, and a second inner-wall portion 53 which extends downwards from the second top portion 51 around the second opening 50*h*. The water supply port 51*h* is located outside the second opening 50*h* in the radial direction.

The second top portion 51 may include an external handle 510 formed between the water supply port 51*h* and the second opening 50*h*. The external handle 510 may include a handle top portion 511 that belongs to the second top portion 51, a first handle side portion 512 that extends downwards from the handle top portion 511 around the second opening 50*h* and belongs to the second inner-wall portion 53, and a second handle side portion 513 that extends downwards from the handle top portion 511 around the water supply port 51*h*. In other words, an "U"-shaped groove that is opened at a bottom is formed by the handle top portion 511, the first handle side portion 512, and the second handle side portion 513.

The internal handle 410 is inserted into the "U"-shaped groove. A user can hold both the internal handle 410 and the external handle 510, so that the upper cover 50*a* and the lower cover 40*a* are not separated from each other when the second washing tub 10*a* is lifted.

In order to more firmly couple the internal handle 410 and the external handle 510, a hook (not shown) may be formed on any one of the internal handle 410 and the external handle 510, and a catch groove (not shown) in which the hook is caught may be formed in the remaining one of the internal handle and the external handle.

Meanwhile, the opening 53*h* may be formed in the second inner-wall portion 53 of the upper cover 50*a* to correspond to a position of the opening 42*h* of the lower cover 40*a*. The first handle side portion 512 of the external handle 510 may be formed by the second inner-wall portion 53. In this case, the first handle side portion 512 defines the second opening 50*h*.

The height of the opening 53*h* is determined by the lower end of the first handle side portion 512. The lower end of the first handle side portion 512 may be substantially at the same height as the lower end of the second handle side portion 513.

Meanwhile, the flow guide 52 may be formed on the upper cover 50*a* to extend around the water supply port 51*h*, especially from a section located opposite the second handle side portion 513. In other words, the flow guide 52 extends from the second top portion 51, at a position that is spaced apart from the second handle side portion 513 outwards in the radial direction. The flow guide 52 extends gradually downwards as it goes inwards along the radial direction from the second top portion 51.

Meanwhile, referring to FIG. 9, the flow path FP may be formed in the washing-tub cover 60*a* to extend from the inlet 452*h* to the outlet 431. If the second washing tub 10*a* is rotated, the water stream developed outwards along the radial direction by the centrifugal force in the container 30 moves upwards along the inner surface of the container 30. After the water stream moved upwards as such flows through the inlet 452*h* into the flow path FP, the water stream is discharged through the outlet 431. As described above, the inlet 452*h* and the outlet 431 are formed in the lower cover 40*a*, and the upper cover 50*a* is combined with the lower cover 40*a* to define the flow path FP.

The flow path FP may be defined as an area formed by the bottom portion 452, the outer-wall portion 43, and the first inner-wall portion 42 of the lower cover 40*a*. The water introduced through the inlet 452*h* into the flow path FP is moved upwards along the inner surface of the sidewall portion 43*a* (i.e. external inner circumferential surface 451) and then is discharged through the outlet 431. At this time, the remaining water that is not discharged through the outlet 431 is not moved upwards by the bottom of the upper cover 50*a*. When the capacity of the flow path FP is sufficient, most of the water in the flow path FP is compressed against the external inner circumferential surface 451 by the centrifugal force, so that the water stream reaching up to the internal inner circumferential surface 453 is not substantially generated. Therefore, according to an embodiment, the internal inner circumferential surface 453 may not contribute to the role of defining the flow path FP.

The check valve 91 may be further provided on the lower cover 40*a* to open or close the inlet 452*h*. The check valve 91 may be configured to be opened or closed by the centrifugal force generated by the rotation of the second washing tub 10*a* or to be opened or closed by water pressure.

The check valve 91 may be disposed in the groove 45. A bottom of the check valve 91 may be in close contact with the top of the bottom portion 452 (i.e. bottom surface of the groove 45), an outer end 91*a* thereof may be fixed to the bottom portion 452, and an inner end 91*b* located at an inner position than the outer end 91*a* along the radial direction may be rotated about the outer end 91*a*. In order to fix the outer end 91*a*, a rib (not shown) for pressing the top of the check valve 91 may protrude from the bottom of the upper cover 50*a*.

The check valve 91 may be made of a material having some elasticity, such as rubber. In this case, the check valve 91 is rotated by the pressure of the water stream passing through the inlet 452*h*, and moment generated by the centrifugal force with the outer end 91*a* as an action point, thus opening the inlet 452*h*. If the second washing tub 10*a* is stopped or decelerated, the check valve returns to its original position by its own weight and the restoring force of the material, thus closing the inlet 452*h*.

However, without being limited thereto, according to an embodiment, the outer end 91*a* may be rotatably connected to the bottom portion 452, so that the check valve 91 may pivot about a portion in which the outer end 91 and the bottom portion 452 are connected. In this case, the check valve 91 may be made of an inelastic material.

A wash course using the second washing tub 10*a* may include a wash cycle and a drain cycle. In the wash cycle, the rotating speed of the second washing tub 10*a* is preferably set such that the water stream in the container 30 does not reach the inlet 452*h*. At this time, the rotating speed of the second washing tub 10*a* may be changed according to the water level in the container 30. However, according to an embodiment, in the case where the quantity of water supplied to the container 30 is configured to be always constant in the wash cycle, the rotation speed of the second washing tub 10*a* may be determined by an experiment when the water stream starts to reach the inlet 452*h*, on the basis of a case where a preset fixed quantity (i.e. an input quantity reported to a user through product instructions or the like) of cloth is put. In order not to exceed the rotation speed determined in this manner, the controller may control the rotating speed of the second washing tub 10*a* in the wash cycle.

Otherwise, the rotation speed of the second washing tub 10*a* in the wash cycle may be controlled, within a range where the water pressure acting through the inlet 452*h* does not overcome the moment acting in a direction where the inlet is closed by the own weight of the check valve 91, even if the water stream moved upwards in the container 30 reaches the inlet 452*h*.

The washing machine according to an embodiment of the present disclosure includes a locking member 81 that is provided on the second washing tub 10*a* and secures the second washing tub to prevent it from being removed from the first washing tub 6 during the rotation of the second washing tub 10*a*. The locking member 81 may be provided on the lower cover 40*a*.

A first end of the locking member 81 may be supported by an elastic member (not shown) secured to the outer-wall portion 43. The locking member 81 is located in the unlock position in a state where the second washing tub 10*a* is stopped, and is moved from the unlock position to a lock position by the centrifugal force when the second washing tub 10*a* is rotated. The lock position is outside the unlock position in the radial direction. The locking member 81 engages with the first washing tub 6 in the lock position to secure the second washing tub 10*a* to the first washing tub 6. A straight line connecting from the unlock position to the lock position (i.e. a moving line of the locking member 81) may cross the first section S1 (see FIG. 6).

A locking groove (not shown) into which the locking member 81 is inserted in the lock position may be formed in the balancer 20. The locking groove may be formed in the inner-diameter portion of the balancer body 21. If the second washing tub 10*a* is mounted on the ring-shaped balancer 20 and is rotated at a predetermined speed or higher while being aligned in a preset rotation position, the locking member 81 is moved outwards in the radial direction by the centrifugal force to reach the lock position. In this process, the locking member 81 passes through a first penetration part 432 formed on the outer-wall portion 43 of the lower cover 40*a* to be inserted into the locking groove. Even if the second washing tub 10*a* is shaken or vibrated during the rotation, the removal of the second washing tub 10*a* is prevented because the locking member 81 and the locking groove engage with each other. Particularly, since the upward movement of the second washing tub 10*a* is restrained, the second washing tub 10*a* does not collide with the top cover 3 or a door (not shown). Even when the second washing tub 10*a* is rotated at high speed (e.g. a spin-dry cycle), damage to devices may be prevented, and accidents may also be prevented.

Since the second washing tub 10*a* is locked not by a separate power mechanism (e.g. motor) but by the centrifugal force that is generated by the rotation of the second washing tub 10*a*, it has advantages in that a lock structure is simplified and it is unnecessary to provide a special control for the lock.

The elastic member is elastically deformed when the locking member 81 is in the lock position, and is restored to its original state when the second washing tub 10*a* stops rotating, so that the locking member 81 returns to the unlock position. If the second washing tub 10*a* stops rotating, the locking member 81 is restored to the unlock position by the restoring force of the elastic member, so that the lock is automatically released. If the washing operation is completed, the lock is automatically released, so that the second washing tub 10*a* may be easily lifted without a user performing a separate operation for releasing the lock.

Meanwhile, the container 30 may include the container body 31, and a rim portion 32 (see FIG. 2) that is formed on the upper end of the container body 31 and surrounds the outer-wall portion 43 outside the lower cover 40*a*. The rim portion 32 may be formed on the upper end of the container body 31, namely, along the circumference of the opening in the top of the container 30. A second penetration part 32*h* may be formed on the rim portion 32 to communicate with the first penetration part 432. The locking member 81 passes through the second penetration part 32*h* to protrude out of the second washing tub 10*a*.

The pair of partition walls 47 and 48 is formed on the lower cover 40*a*. A space SP is provided between the pair of partition walls 47 and 48 to accommodate a locker 80 therein. The space SP is separated from the flow path FP by the pair of partition walls 47 and 48. Each of the partition walls 47 and 48 may extend from the bottom portion 452 to the outer-wall portion 43. Furthermore, each of the partition walls 47 and 48 is connected to the internal inner circumferential surface 453. In other words, the space SP is surrounded by the outer-wall portion 43, the pair of partition walls 47 and 48, and the internal inner circumferential surface 453, and is opened at its top. The opened top is closed again by the bottom of the upper cover 50*a*.

Particularly, the upper ends of the partition walls 47 and 48 come into close contact with the bottom of the upper cover 50*a*, thus preventing water contained in the flow path FP from overflowing the partition walls 47 and 48 and flowing into the space SP. The bottom of the flow guide 52 may come into close contact with the upper ends of the partition walls 47 and 48.

In an embodiment, in order to more reliably maintain air-tightness between the partition walls 47 and 48 and the upper cover 50*a*, a sealer (not shown) may be provided to seal gaps between the upper ends of the pair of partition walls 47 and 48 and the bottom of the upper cover 50*a*. The sealer is made of a soft material (e.g. rubber) to be interposed between the pair of partition walls 47 and 48 and the bottom of the upper cover 50*a*. In this case, one surface of the sealer is pressed by the partition walls 47 and 48, while the other surface is pressed by the bottom of the upper cover 50*a*.

Figure 10:
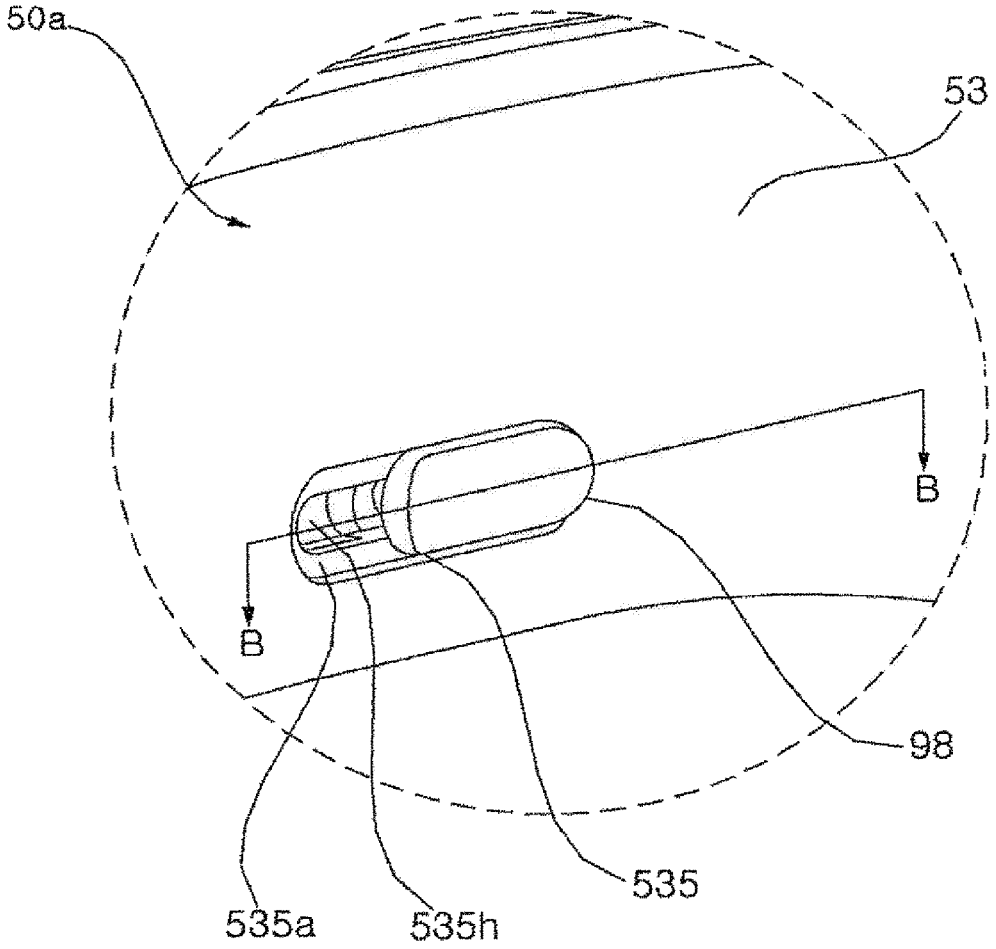
FIG. 10 is an enlarged view illustrating portion A of FIG. 4.
Figure 11:
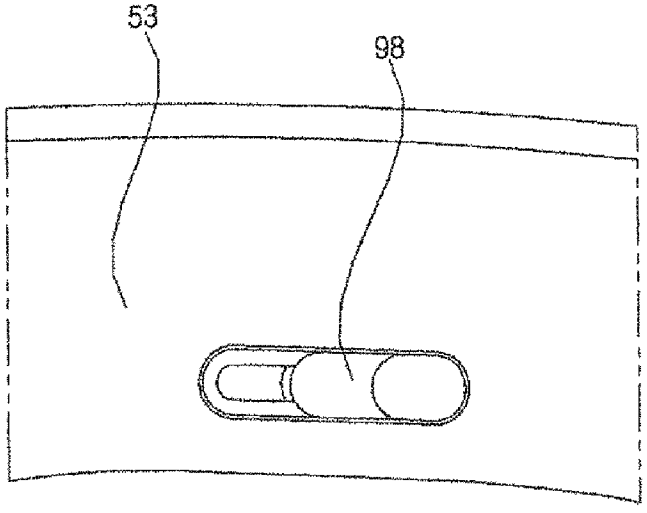
FIG. 11(*a*) illustrates a state in which a slide lock is in a binding position, and FIG. 11(*b*) illustrates a state in which the slide lock is in an unbinding position.
Figure 11:
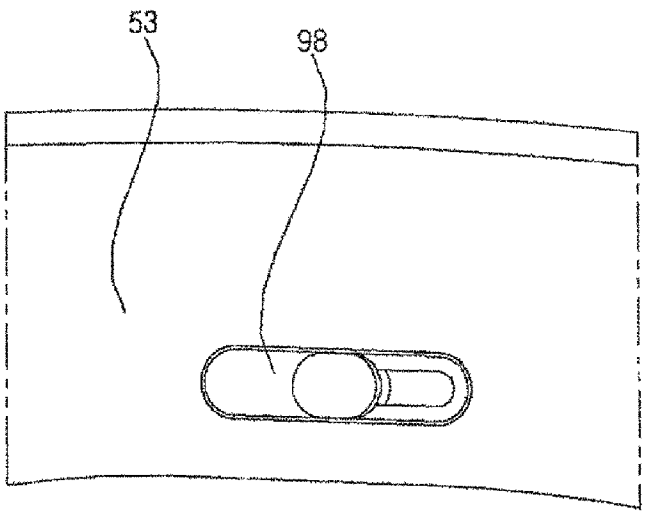
Figure 12:
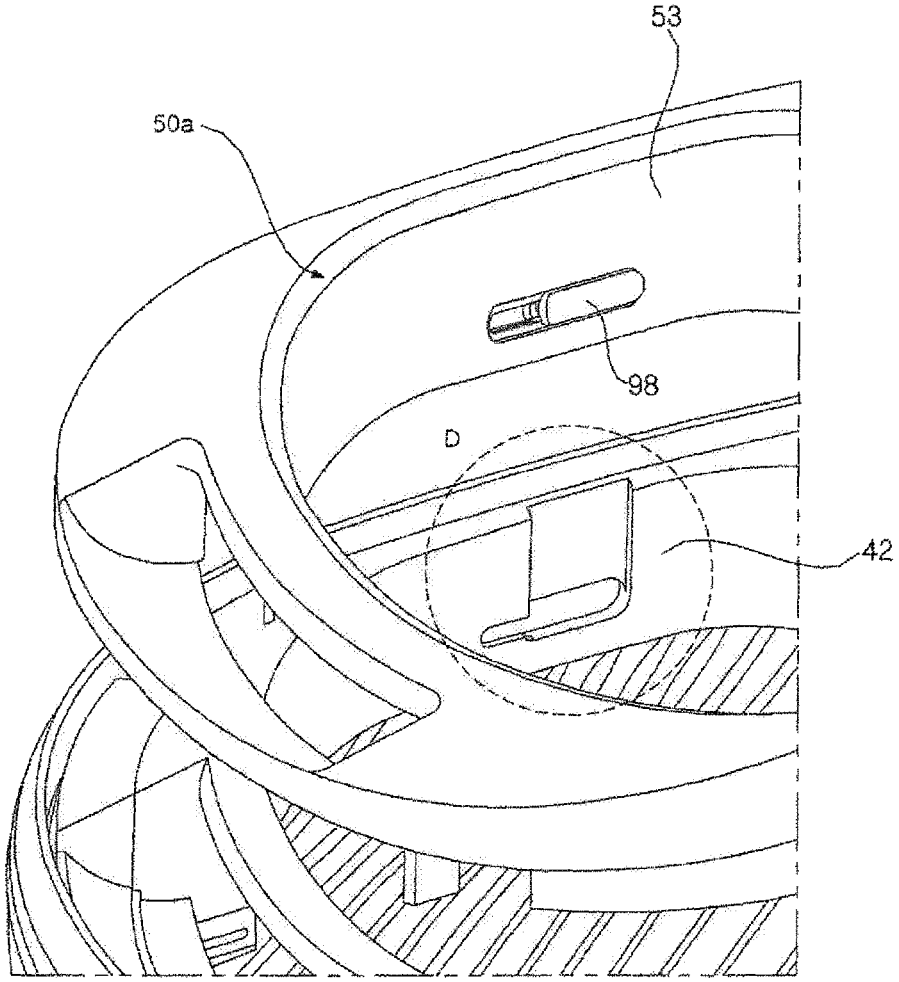
FIG. 12 illustrates a state in which the slide lock moves to the unbinding position, so that the upper cover is separated from a lower cover.
Figure 13:
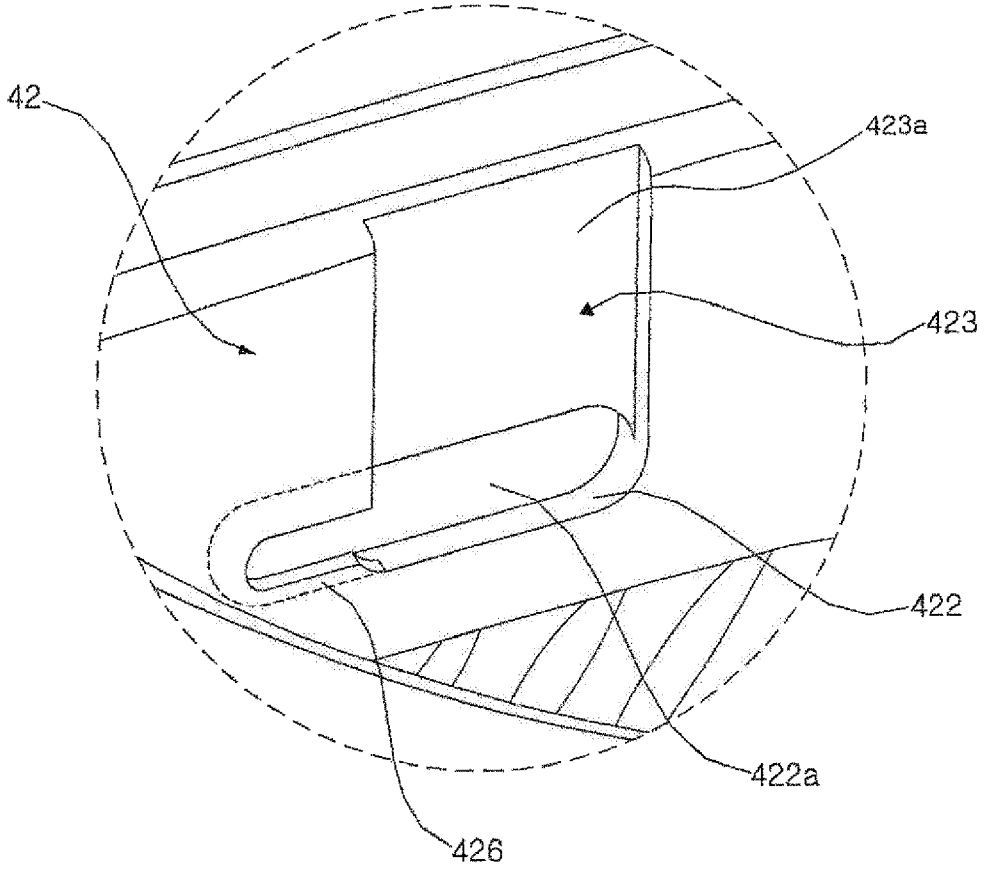
FIG. 13 is an enlarged view illustrating portion D of FIG. 12.
Figure 14:
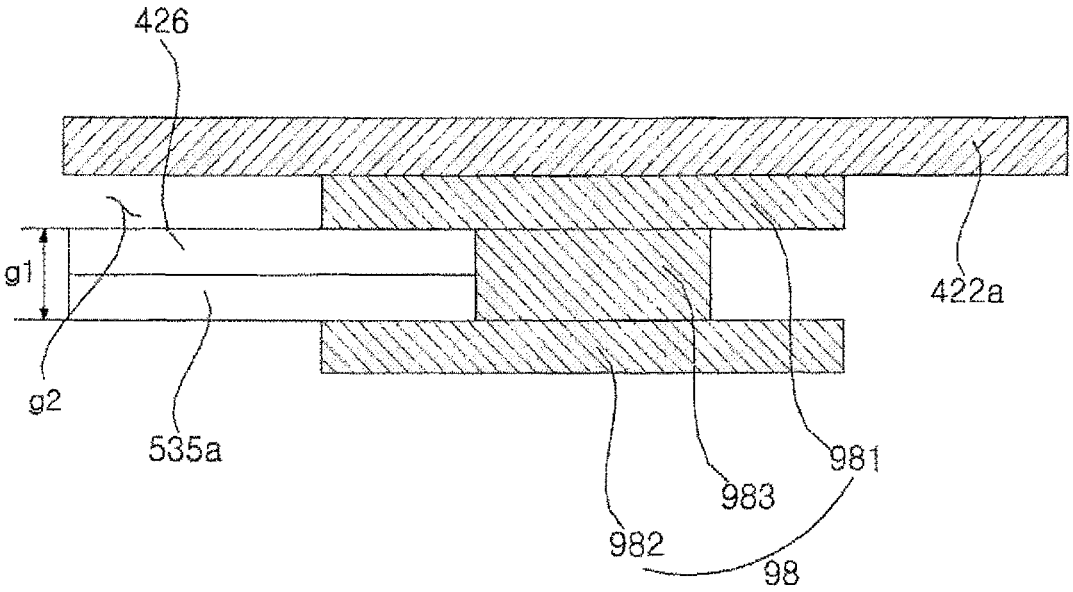
FIG. 14 is a diagram taken along line B-B of FIG. 10.

FIG. 10 is an enlarged view illustrating portion A of FIG. 4. FIG. 11(*a*) illustrates a state in which a slide lock is in a binding position, and FIG. 11(*b*) illustrates a state in which the slide lock is in an unbinding position. FIG. 12 illustrates a state in which the slide lock moves to the unbinding position, so that the upper cover is separated from a lower cover. FIG. 13 is an enlarged view illustrating portion D of FIG. 12. FIG. 14 is a diagram taken along line B-B of FIG. 10.

Referring to FIGS. 10 to 14, the slide lock 98 is provided on the upper cover 50*a*, and is movable between the binding position and the unbinding position. The slide lock 98 is bound to the lower cover 40*a* in the binding position, and is separated from the lower cover 40*a* in the unbinding position.

When the slide 98 is in the binding position, the lower cover 40*a* and the upper cover 50*a* are connected to each other via the slide lock 98. Therefore, even if a user optionally lifts the washing-tub cover 60*a*, the lower cover 40*a* and the upper cover 50*a* are not separated from each other.

In contrast, when it is necessary to disassemble the washing-tub cover 60*a* for maintenance or repair, a user may separate the upper cover 50*a* from the lower cover 40*a*, by moving the slide lock 98 to the unbinding position.

A movement guide slot 535*h* may be formed in the upper cover 50*a* to guide the movement of the slide lock 98. The slide 98 may move between the binding position and the unbinding position while engaging with the movement guide slot 535*h*. The movement guide slot 535*h* may be formed in the second inner-wall portion 53.

A movement guide groove 535 may be formed in the second inner-wall portion 53 to extend long approximately in a horizontal direction. The movement guide slot 535*h* may be formed in the bottom 535*a* of the movement guide groove 535.

The slide lock 98 may include a first slide tab 981, a second slide tab 982, and a tab connector 983 connecting the first slide tab 981 and the second slide tab 982. The connector 983 may be positioned inside the movement guide slot 535*h*, the first slide tab 981 may be positioned on a back surface of the second inner-wall portion 53, and the second slide tab 982 may be positioned on a front surface of the second inner-wall portion 53. Particularly, the width of each of the first slide tab 981 and the second slide tab 982 is greater than the width of the movement guide slot 535*h*, so that the slide lock 98 is not easily separated from the movement guide slot 535*h*.

By appropriately designing the width of the first slide tab 981 or the width of the second slide tab 982, the width of the tab connector 983, and a first gap g1 (see FIG. 14), the slide lock 98 may be manipulated in a proper posture when necessary, and the slide lock 98 may be separated from the movement guide slot 535*h*.

Otherwise, the first slide tab 981 or the second slide tab 982 is configured to be detachably coupled to the tab connector 983. Thus, as necessary, the slide lock 98 may be disassembled and then separated from the movement guide slot 535*h*.

The first slide tab 981 and the second slide tab 982 may be disposed, respectively, on both sides of the tab connector 983, and each slide tab may be formed longer than the tab connector 983. In this case, the first gap g1 corresponding to at least the thickness of the tab connector 983 may be formed between the first slide tab 981 and the second slide tab 982, in front of or behind the tab connector 983.

When the slide lock 98 is in the binding position, a binding part 426 formed on the lower cover 40*a* and a bottom 535*a* of the movement guide groove 535 formed in the upper cover 50*a* are inserted into the first gap g1. An avoidance groove 422 may be formed in the first inner-wall portion 42 of the lower cover 40*a*. The avoidance groove 422 is a groove that guides the movement of the first slide tab 981, and may extend long in a direction corresponding to the movement guide slot 535*g*. A second gap g2 is formed between the binding part 426 and the bottom 422*a* of the avoidance groove 422. When the slide lock 98 is in the binding position, the first slide tab 981 is inserted into the second gap g2.

When the slide lock 98 is in the binding position, the first slide tab 981 is located in the avoidance groove 422. Thus, even if only the upper cover 50*a* is lifted up, the first slide tab 981 is caught by the inner surface of the avoidance groove 442, so that a connection between upper the cover 50*a* and the lower cover 40*a* via the slide lock 98 is maintained.

A removal groove 423 may be formed in the first inner-wall portion 42. The removal groove 423 extends long in the vertical direction, and is connected at a lower end thereof to the avoidance groove 442. The removal groove 423 is shallower in depth than the avoidance groove 442, so that a step is formed between the bottom 423*a* of the removal groove 423 and the bottom 422*a* of the avoidance groove 422. When the slide lock 98 is in the binding position, a portion of the inner surface of the avoidance groove 422 corresponding to the step interferes with the first slide tab 981, thus preventing the first slide tab 981 from entering the removal groove 423.

The removal groove 423 guides the movement of the slide lock 98, when the upper cover 50*a* is lifted to be separated from the lower cover 40*a* in the state where the slide lock 98 is moved to the unbinding position.

If the slide lock 98 reaches the unbinding position, the binding part 426 is separated from the slide lock 98. Therefore, the slide lock 98 may be moved in the depth direction of the avoidance groove 422 by a length corresponding to the thickness of the binding part 426. The thickness of the binding part 426 is preferably equal to or more than the step between the bottom 423*a* of the removal groove 4234 and the bottom 422*a* of the avoidance groove 422, so that the first slide tab 981 may enter the removal groove 424. Such a removal groove 423 may be configured to extend to the first top portion 41 of the first inner-wall portion 42, so that the upper end of the removal groove 423 is opened.

Hereinafter, a washing tub 10*b* in accordance with a second embodiment will be described with reference to FIGS. 15 to 27. The same reference numerals denote components common to both the first and second embodiments, and a duplicated description of the common components will be omitted.

Figure 15:
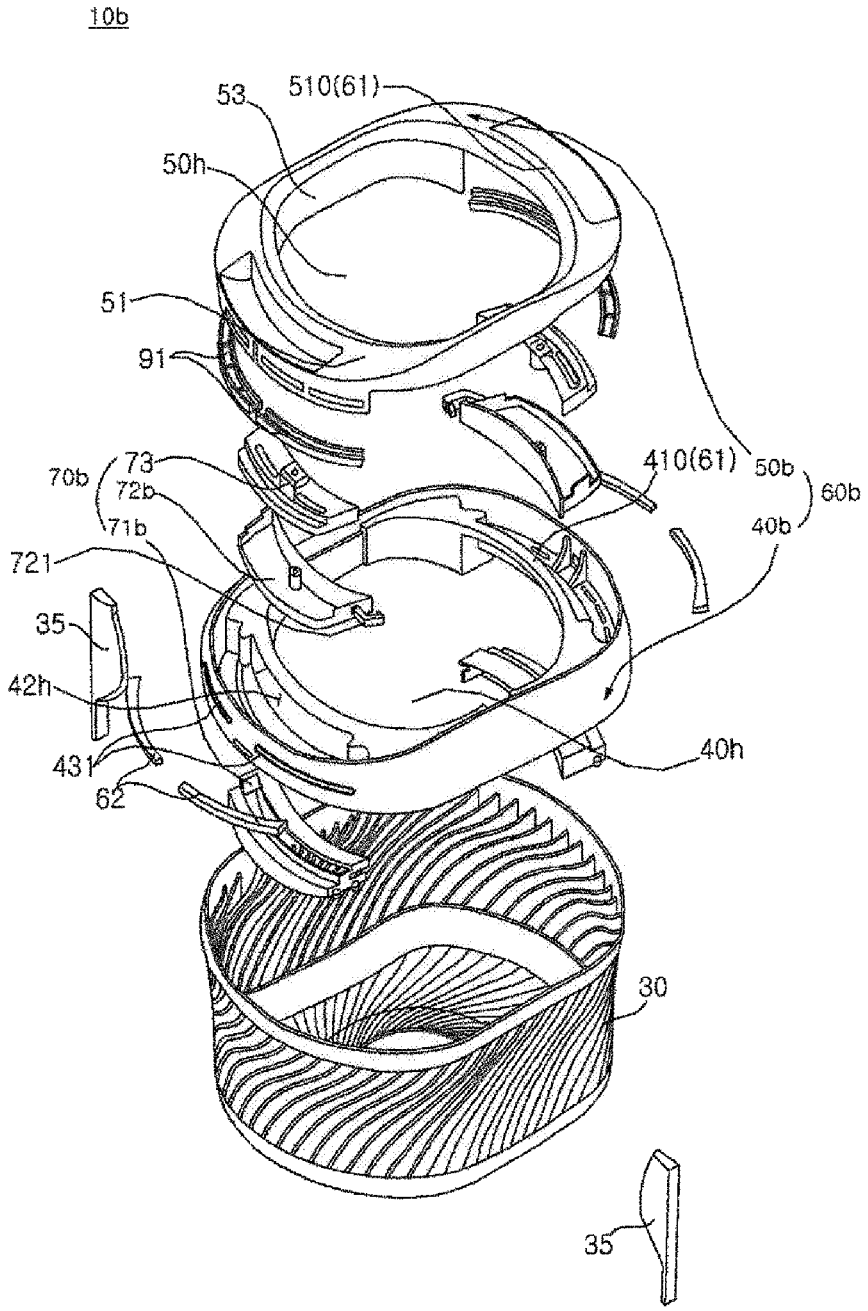
FIG. 15 is an exploded perspective view of a second washing tub in accordance with a second embodiment.
Figure 16:
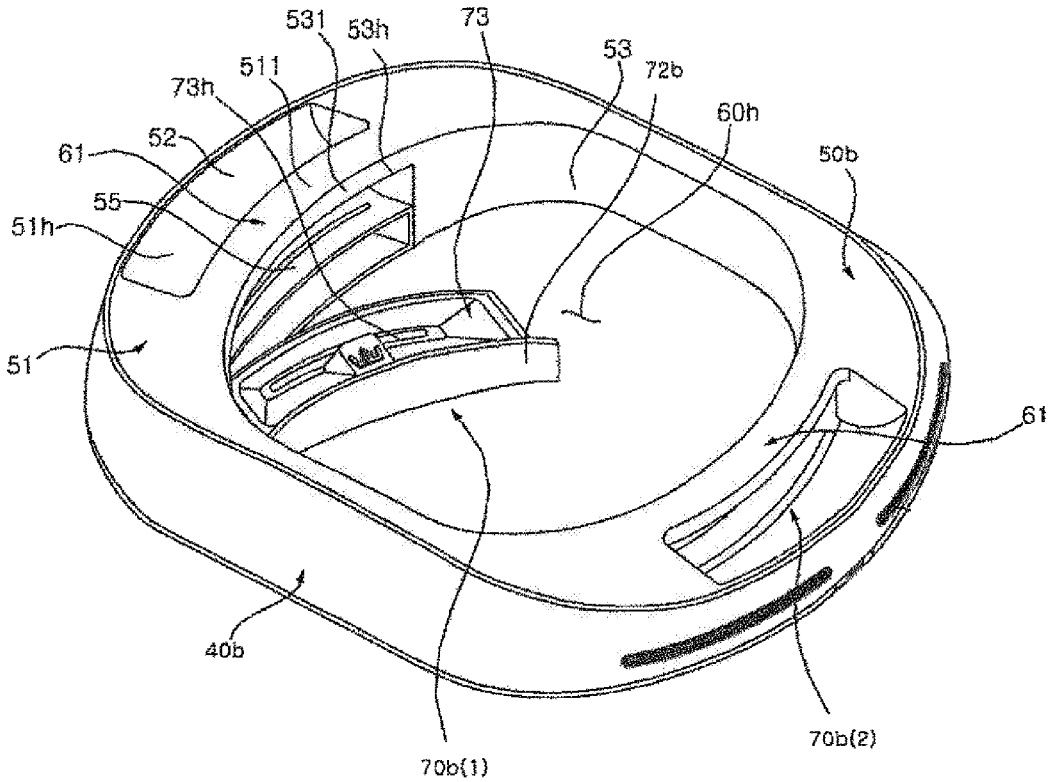
FIG. 16 is a perspective view illustrating a washing-tub cover illustrated in FIG. 15.
Figure 17:
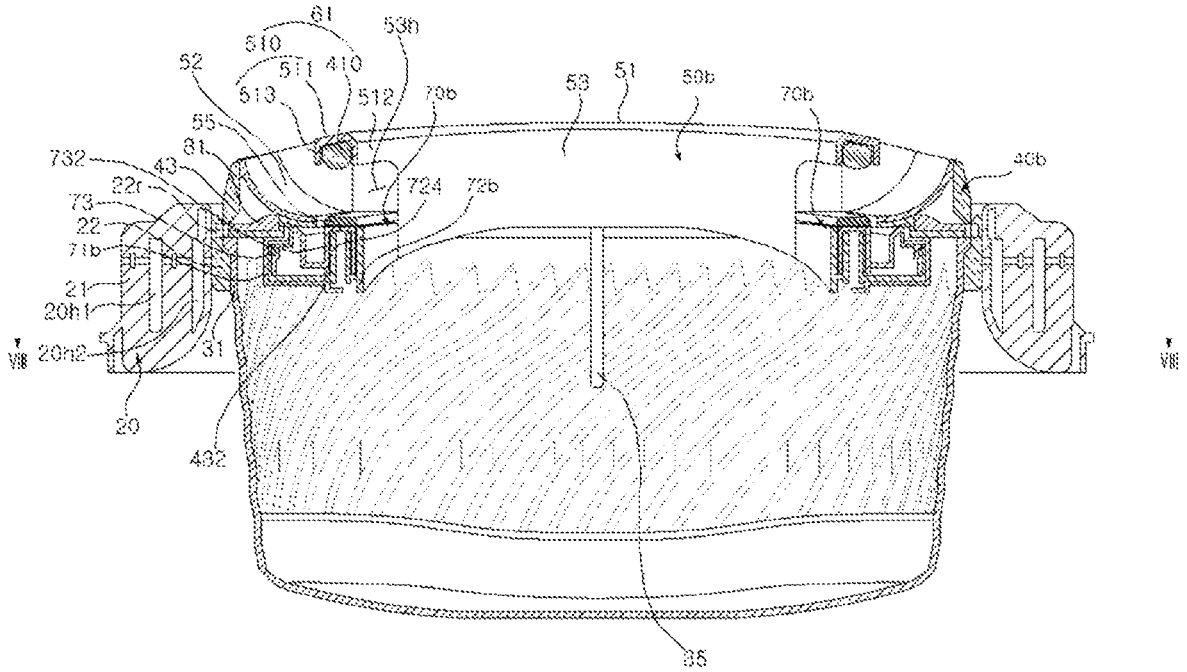
FIG. 17 is a sectional view of the second washing tub illustrated in FIG. 15.

FIG. 15 is an exploded perspective view of a second washing tub in accordance with a second embodiment. FIG. 16 is a perspective view illustrating a washing-tub cover. FIG. 17 is a sectional view of the second washing tub illustrated in FIG. 15.

Figure 18:
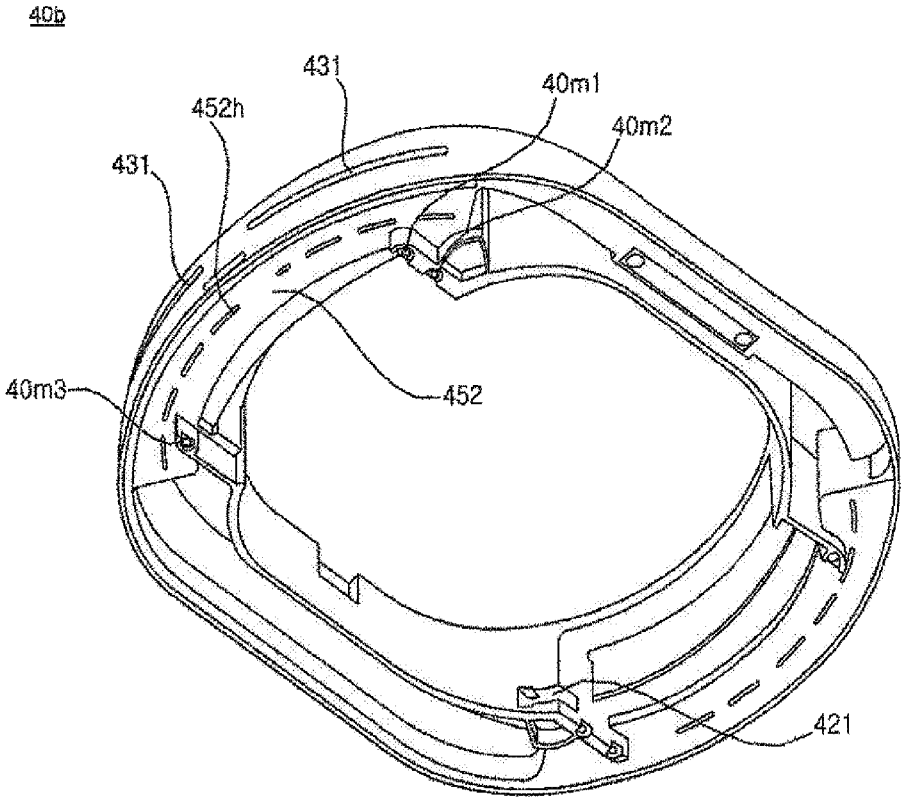
FIG. 18 is a bottom perspective view of a lower cover illustrated in FIG. 15.

FIG. 18 is a bottom perspective view of a lower cover. Hereinafter, a description will be made with reference to FIGS. 15 to 18.

A sub dispenser 70*b* may include a receptor housing 71*b*, an additive receptor 72*b* that is retractably received in the receptor housing 71*b* and is opened at a top thereof, and a receptor cover 73 that covers the opened top of the additive receptor 72*b*. The receptor cover 73 may be detachably coupled to the additive receptor 72*b*. An opening 73*h* through which water discharged from the main dispenser 16 passes is formed in the drawer cover 73, so that water passing through the opening 73*h* is fed into the additive receptor 72*b*.

The additive receptor 72*b* may be provided to be rotatable about the receptor housing 71*b*. The additive receptor 72*b* may include a container 722 (see FIG. 27) that contains the additive therein and is opened at a top thereof, and a connecting link 721 (see FIGS. 15 and 27) protruding from the container 722 may be rotatably connected to the washing-tub cover 60 (preferably, the lower cover 40*b*). In other words, the connecting link 721 may be connected at a front end thereof to the additive receptor 72*b*, and be rotatably connected at a rear end thereof to the washing-tub cover 60*b*.

As the connecting link 721 rotates, the additive receptor 72*b* goes into and out of the receptor housing 71*b*. Therefore, by designing the connecting link 721 with a proper length and shape, it is easier to take the additive receptor 72*b* out from the receptor housing 71*b*, and preferably, it is possible to completely the additive receptor out therefrom, thus improving convenience when the additive is added, as compared with a case where the additive receptor 72*b* is slidably installed in the receptor housing 71*b*.

An opening 715 through which the connecting link 721 passes may be formed in a second side portion 714 of the receptor housing 71*b*. In a state where the additive receptor 72*b* is located in the receptor housing 71*b*, the rear end of the connecting link 721 passes through the opening 715 and protrudes out from the receptor housing 71*b*. In such a protruding portion, the connecting link 721 is rotatably coupled to the washing-tub cover 60*b*.

For example, the rear end of the connecting link 721 may be rotatably coupled (or hingedly coupled) to the lower cover 40*b*. A mount (not shown) to which the rear end of the connecting link 721 is rotatably coupled may be formed inside the lower cover 40*b*. In detail, a projection protruding upwards and/or downwards (or a projection insert groove depressed upwards and/or downwards) may be formed on the rear end of the connecting link 721, and a projection insert groove (or a projection) corresponding to the projection may be formed on the mount of the lower cover 40*b*, so that the projection (or the projection insert groove) may be rotated in the projection insert groove (or the projection) and thus the connecting link 721 may be rotated about the rear end. However, the present disclosure is not necessarily limited thereto. According to an embodiment, the connecting link may be installed in the receptor housing 71*b* to be slidable in a linear direction.

Referring to FIG. 17, the additive receptor 72*b* may include a siphon pipe 724 that protrudes upwards from the bottom, and the receptor cover 73 may include a siphon cap 732 that covers the siphon pipe 724.

An exit of the siphon pipe 724 is formed in the bottom of the additive receptor 72*b*, and a flow path having an annular cross-section is formed between the siphon cap 73 and an outer circumferential surface of the siphon pipe 724. Such a structure is suitable to supply the liquid additive.

If water is supplied to the sub dispenser 70*a* and thus a water level in the additive receptor 72*b* rises gradually, water moves upwards along the flow path having the annular cross-section and thus flows through an entrance of an upper end of the siphon pipe 724 into the siphon pipe 724. Subsequently, the water is discharged through the exit of a lower end of the siphon pipe 724 to the container 30.

Figure 19:
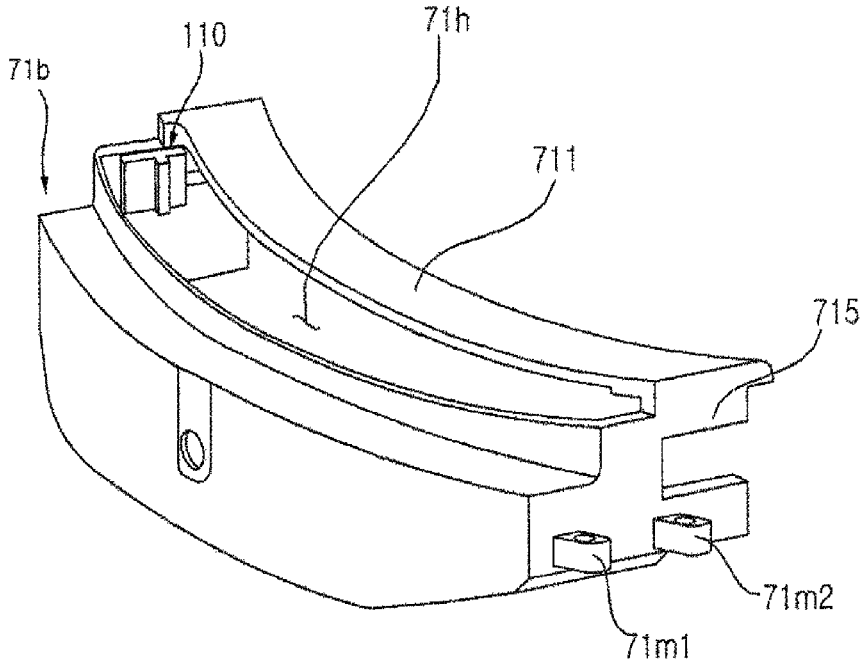
FIG. 19 is a perspective view illustrating an assembly of a receptor housing and a slider.
Figure 20:
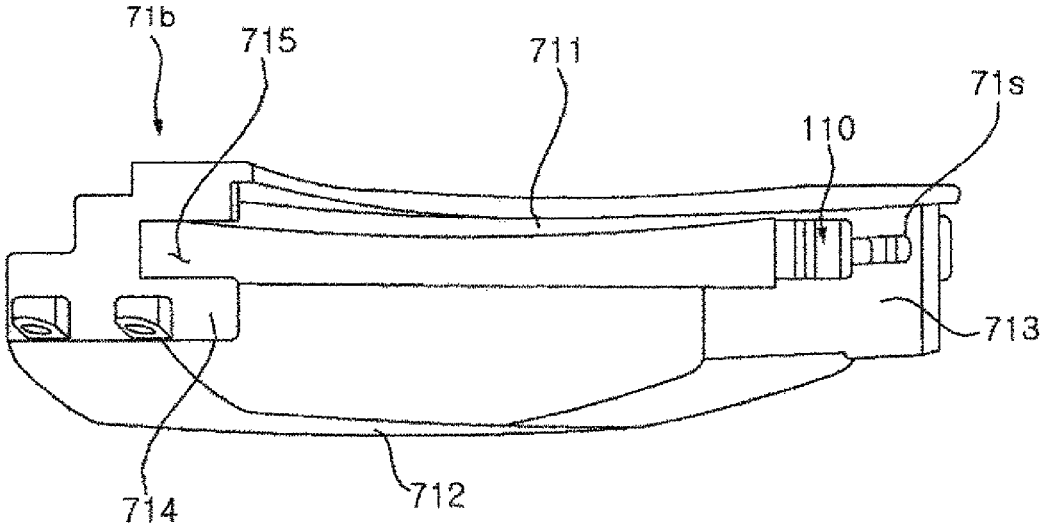
FIG. 20 is a perspective view of the assembly of FIG. 19 when viewed from another angle.
Figure 21:
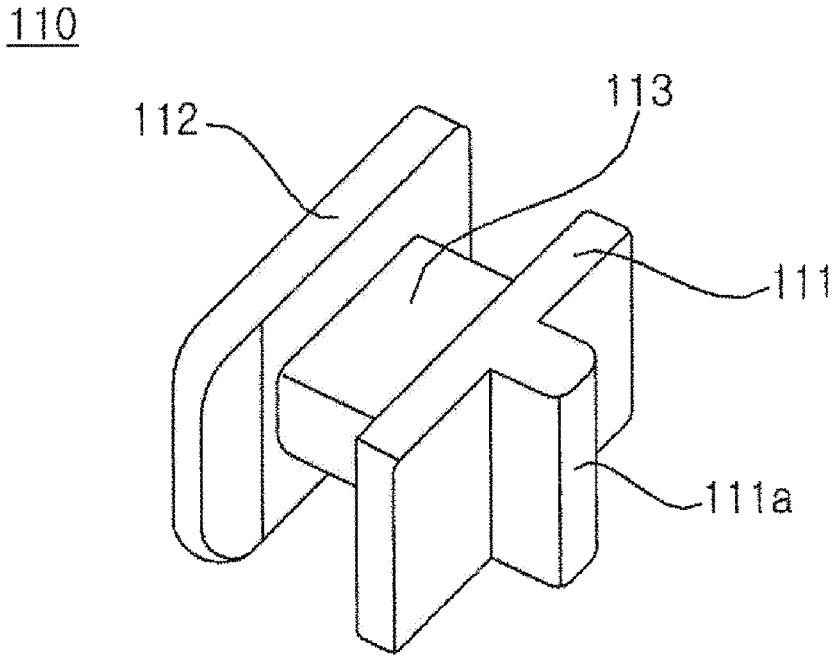
FIG. 21 is a perspective view illustrating the slider.
Figure 22:
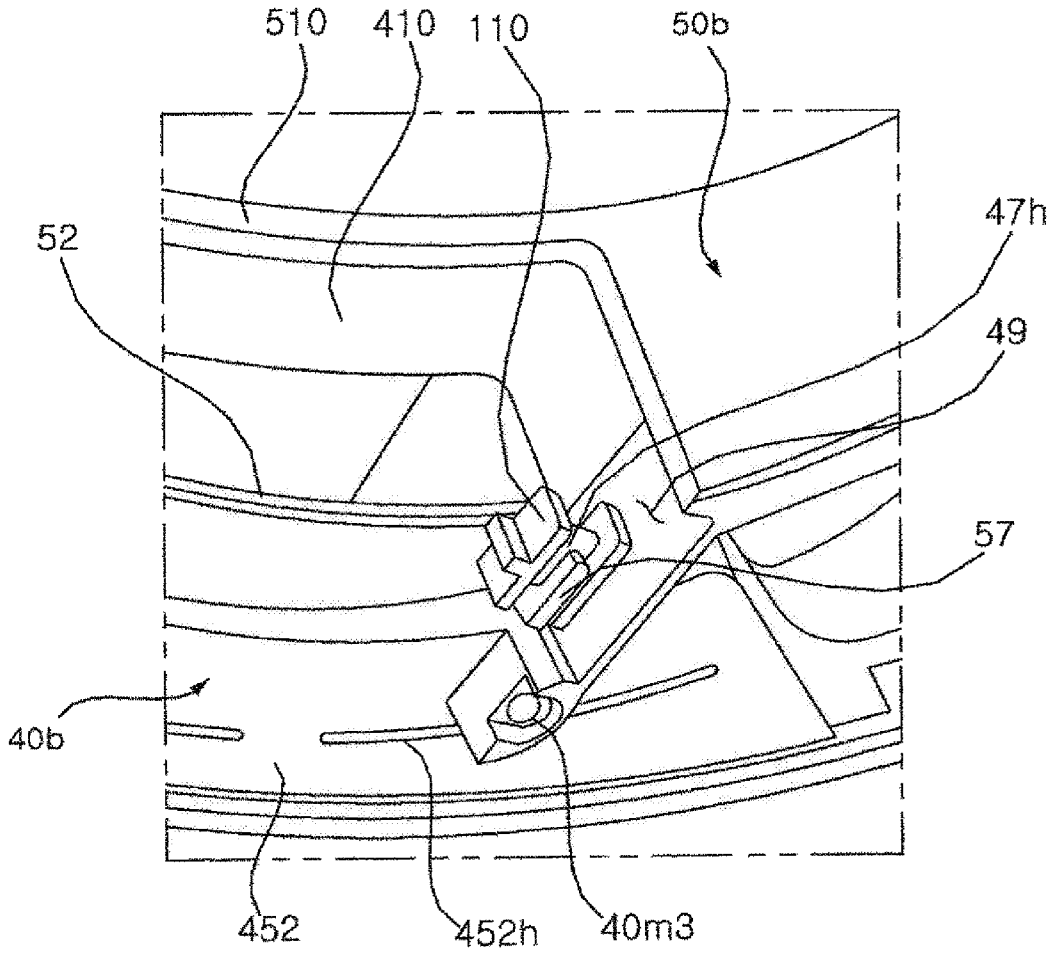
FIG. 22 illustrates a state in which the slider and a binding tab are bound to each other.
Figure 23:
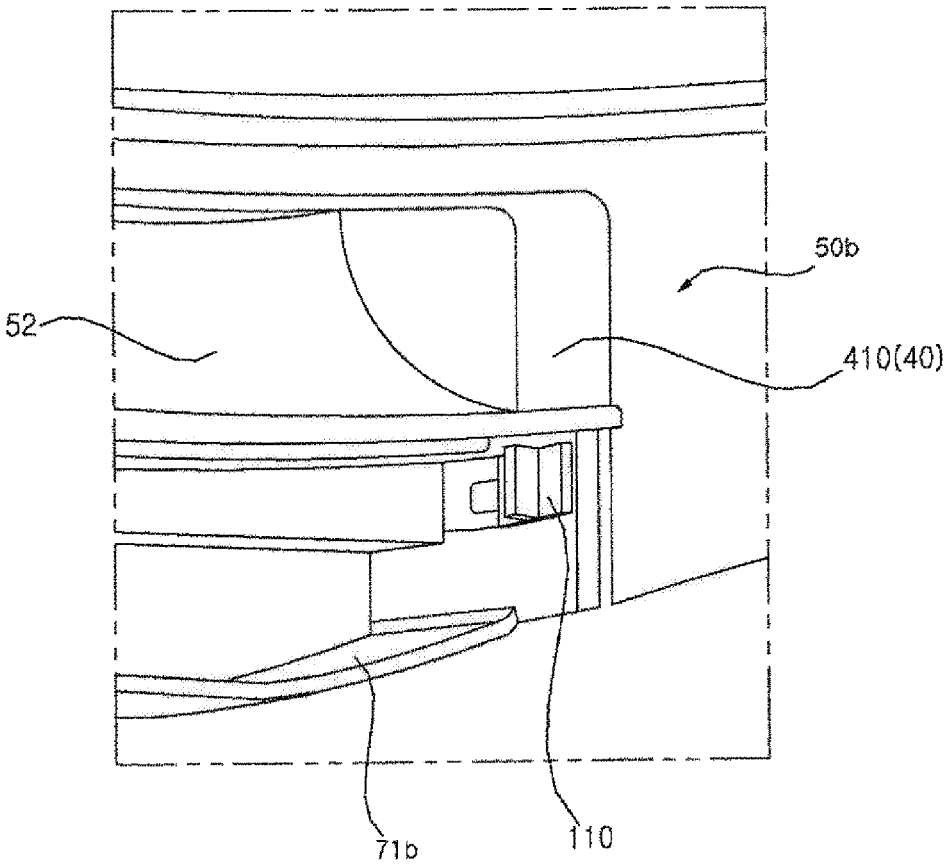
FIG. 23 illustrates a state in which the slider is in an unbinding position.
Figure 24:
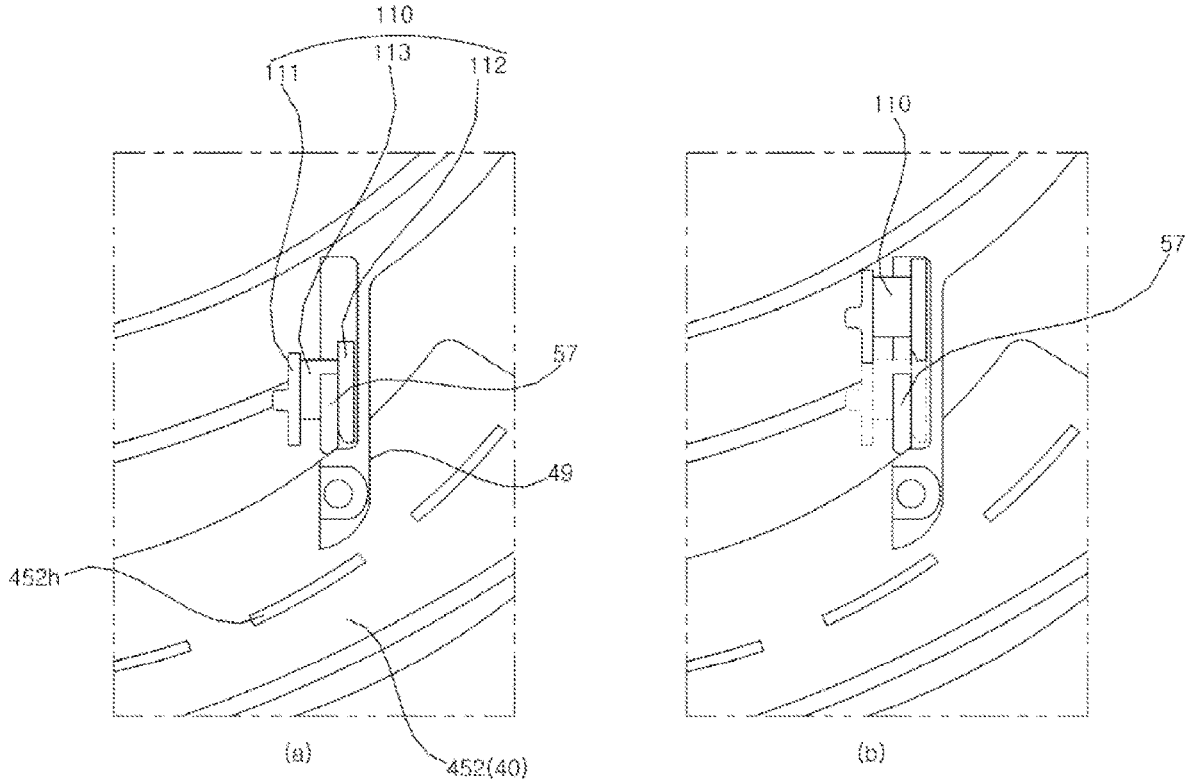
FIG. 24(*a*) illustrates a state in which the slider and the binding tab are bound to each other, and FIG. 24(*b*) illustrates a state in which the slider and the binding tab are unbound from each other.
Figure 25:
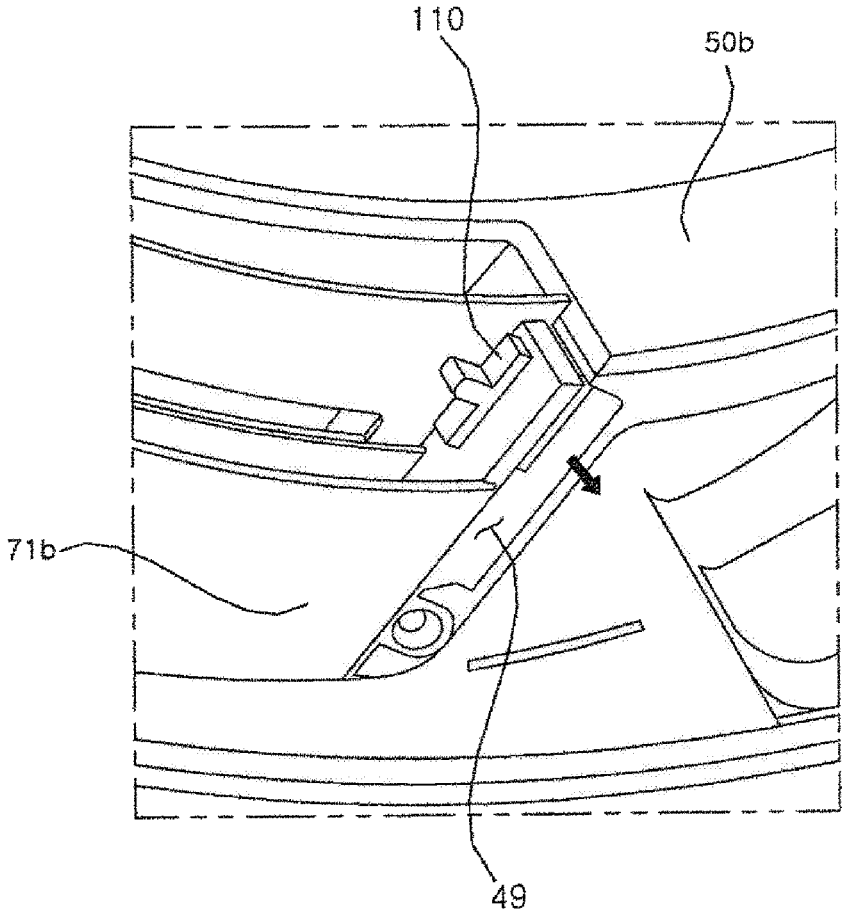
FIG. 25 indicates a direction in which the receptor housing is separated from the lower cover.
Figure 26:
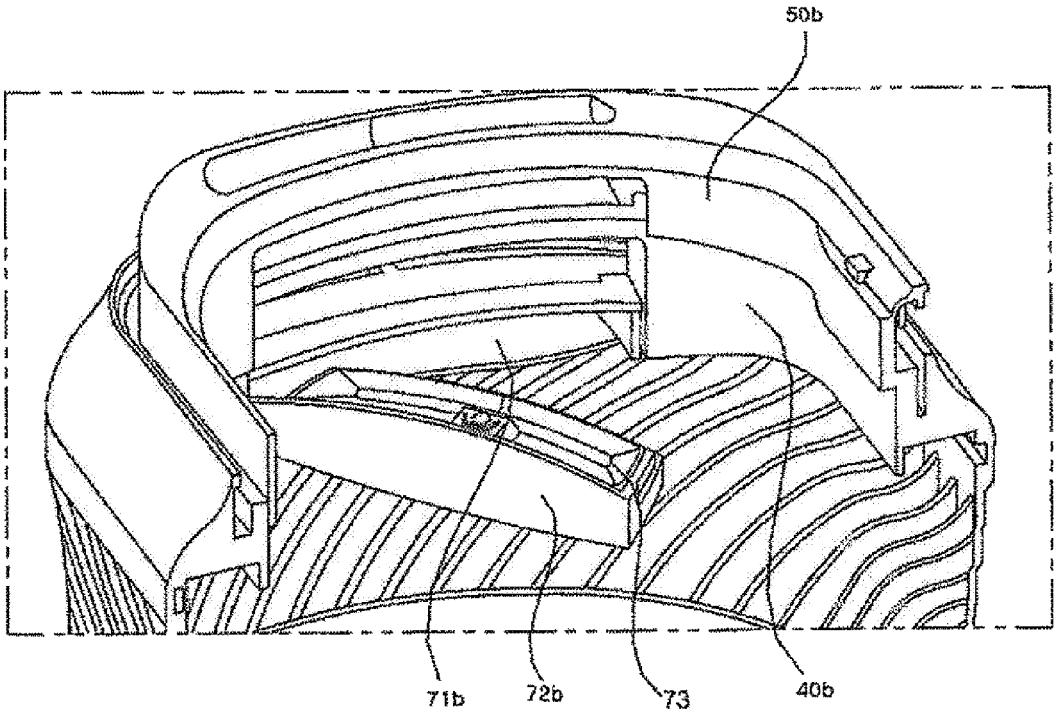
FIG. 26 illustrates a state in which an upper cover is being separated from the lower cover.
Figure 27:
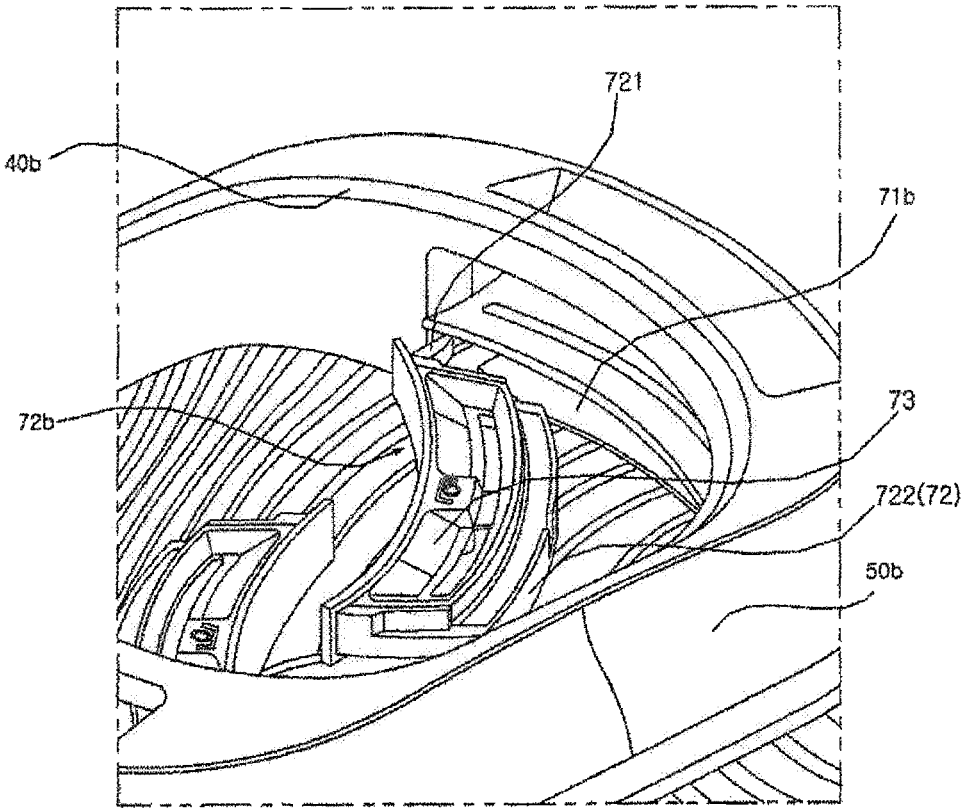
FIG. 27 illustrates a state in which an additive receptor is taken out from the receptor housing.

FIG. 19 is a perspective view illustrating an assembly of a receptor housing and a slider. FIG. 20 is a perspective view of the assembly of FIG. 19 when viewed from another angle. FIG. 21 is a perspective view illustrating the slider. FIG. 22 illustrates a state in which the slider and a binding tab are bound to each other. (In FIG. 22, the receptor housing is omitted.) FIG. 23 illustrates a state in which the slider is in an unbinding position. FIG. 24(*a*) illustrates a state in which the slider and the binding tab are bound to each other, and FIG. 24(*b*) illustrates a state in which the slider and the binding tab are unbound from each other. (In FIG. 24, the receptor housing is omitted.) FIG. 25 indicates a direction in which the receptor housing is separated from the lower cover. FIG. 26 illustrates a state in which an upper cover is being separated from the lower cover. FIG. 27 illustrates a state in which an additive receptor is taken out from the receptor housing.

Referring to FIGS. 19 to 27, the receptor housing 71*b* provides a space in which the additive receptor 72*b* is accommodated, and may be coupled to the lower cover 40*b*. The receptor housing 71*b* may be fastened to the lower cover 40*b* by a fastening member such as a screw or a bolt.

Fastening tabs 71*m*1 and 71*m*2 each having a hole may protrude from an outer surface of the receptor housing 71*b*, and mount grooves 40*m*1, 40*m*2, and 40*m*3 having a shape corresponding to that of the fastening tab 47 may be formed in the lower cover 40*b* (see FIG. 25). After a certain bolt passes through the hole, the bolt may be fastened to a fastening hole (not shown) formed in each of the mount grooves 40*m*1, 40*m*2, and 40*m*3. A plurality of fastening tabs 47 may be formed, and a plurality of mount grooves 40*m*1, 40*m*2, and 40*m*3 may also be formed to correspond to the fastening tabs.

The receptor housing 71*b* is shaped to surround the additive receptor 72*b*, and is opened at a front thereof to allow the additive receptor 72*b* to go in and out, thus forming an entryway. An opening is formed in the top portion 711 of the receptor housing 71*b*, so that water flowing down along the flow guide 52 in the water supply process passes through the opening and then is supplied to the additive receptor 72*b*.

The receptor housing 71*b* has a bottom portion 712 that is formed on a bottom spaced apart from the top portion 711, and water discharged through the siphon pipe 724 of the additive receptor 72*b* flows along the bottom portion 712 to be supplied into the container 30.

The receptor housing 71*b* is provided with the slider 110. The slider 110 is provided to be movable between the binding position (position shown in FIG. 24(*a*)) and the unbinding position (position shown in FIG. 24(*b*)). The slider 110 may be installed at any one (hereinafter, referred to as a first side portion 713) of the side portions 713 and 714 connecting the top portion 711 and the bottom portion 712 of the receptor housing 71*b*.

The upper cover 50*b* is provided with a binding tab 57, so that the slider is bound to the binding tab 57 when the slider 110 is in the binding position. Referring to FIG. 22, the binding tab 57 may extend downwards from the bottom of the flow guide 52, with a catch groove 57*h* being formed on a lower end thereof to engage with the slider 110.

The receptor housing 71*b* may have a guide slot 71*s* that guides the slider to be movable between the binding position and the unbinding position in a state where the slider 110 is fitted therein. The guide slot 71*s* may be formed in the first side portion 713. The guide slot 71*s* may extend long in the shape of a straight line.

The catch groove 57*h* may be located at a height corresponding to that of the guide slot 71*s*, and may be opened towards the slider 110. In other words, while the slider 110 moves in a first direction to reach the binding position, a connecting section 113 of the slider 110 that will be described below is inserted into the catch groove 57*h*. When the slider 110 moves in a second direction (direction opposite to the first direction), the connecting section 113 is removed from the catch groove 57*h*.

If the slider 110 moves to the binding position in a state where the receptor housing 71*b* is coupled to the lower cover 40*b*, the slider 110 is bound to the binding tab 57, thus preventing the upper cover 50*b* from being separated from the lower cover 40*b*.

If the additive receptor 72 is introduced into the receptor housing 71*b* in the state where the slider 110 is in the unbinding position, the additive receptor 72 may push the slider 110 to the binding position during its rotation (in an embodiment, during the linear movement of the additive receptor 72*b*, when it is provided to be slidable in a linear direction relative to the receptor housing 71*b*).

In other words, the additive receptor 72*b* is configured to interfere with the slider 110 while the additive receptor being received in the receptor housing 71*b*, so that the additive receptor 72 may push the slider 110 to the binding position. In this case, even if a user himself or herself does not operate the slider 110 to the binding position, the slider 110 is automatically bound to the binding tab 57 while the additive receptor 72*b* moves to a given position (i.e. position where it is inserted into the receptor housing 71*b*).

The slider 110 may include an internal section 111 located inside the receptor housing 71*b*, an external section 112 located outside the receptor housing 71*b*, and a connecting section 113 passing through the guide slot 71*s* and connecting the internal section 111 and the external section 112.

The connecting section 113 is connected to the binding tab 57 between the receptor housing 71*b* and the external section 112. The connecting section 113 is moved within the guide slot 71*s*, and is inserted into the catch groove 57*h* of the binding tab 57 when the slider 110 is in the binding position.

Each of the internal section 111 and the external section 112 may have a size or a shape that does not permit the internal or external section to pass through the guide slot 71*s*. In this case, the internal section 111 or the external section 112 may be detachably coupled to the connecting section 113, so that the detached connecting section 113 may be inserted into the guide slot 71*s* and then the internal section 111 or the external section 112 may be coupled to the connecting section 113.

The internal section 111 may be provided with an interference projection 111*a*. The interference projection 111*a* is shaped to protrude from a peripheral portion. Thus, while the additive receptor 72*b* is received in the receptor housing 71*b*, the additive receptor interferes with the interference projection 111*a* and thereby moves the slider 110 to the fastening position.

A movement guide groove 49 may be formed in the lower cover 40*b* to guide the movement of the external section 112. In order to correspond to the displacement of the slider 110, the internal section 111 is moved in the movement guide groove 49. The movement guide groove 49 may be formed on a surface opposite to the first side portion 713 of the receptor housing 71*b*.

The lower end of the movement guide groove 49 is opened. Thus, as shown in FIG. 15, if the receptor housing 71*b* is moved in a direction shown by the arrow in the state where the slider 110 is separated from the binding tab 57 and the bolt of the fastening tab 47 is removed, the slider 110 may escape through the open lower end of the movement guide groove 49.

Hereinafter, a washing tub 10*c* in accordance with a third embodiment will be described with reference to FIGS. 28 to 33. The same reference numerals denote components common to the preceding embodiments and the third embodiment, and a duplicated description of the common components will be omitted.

Figure 28:
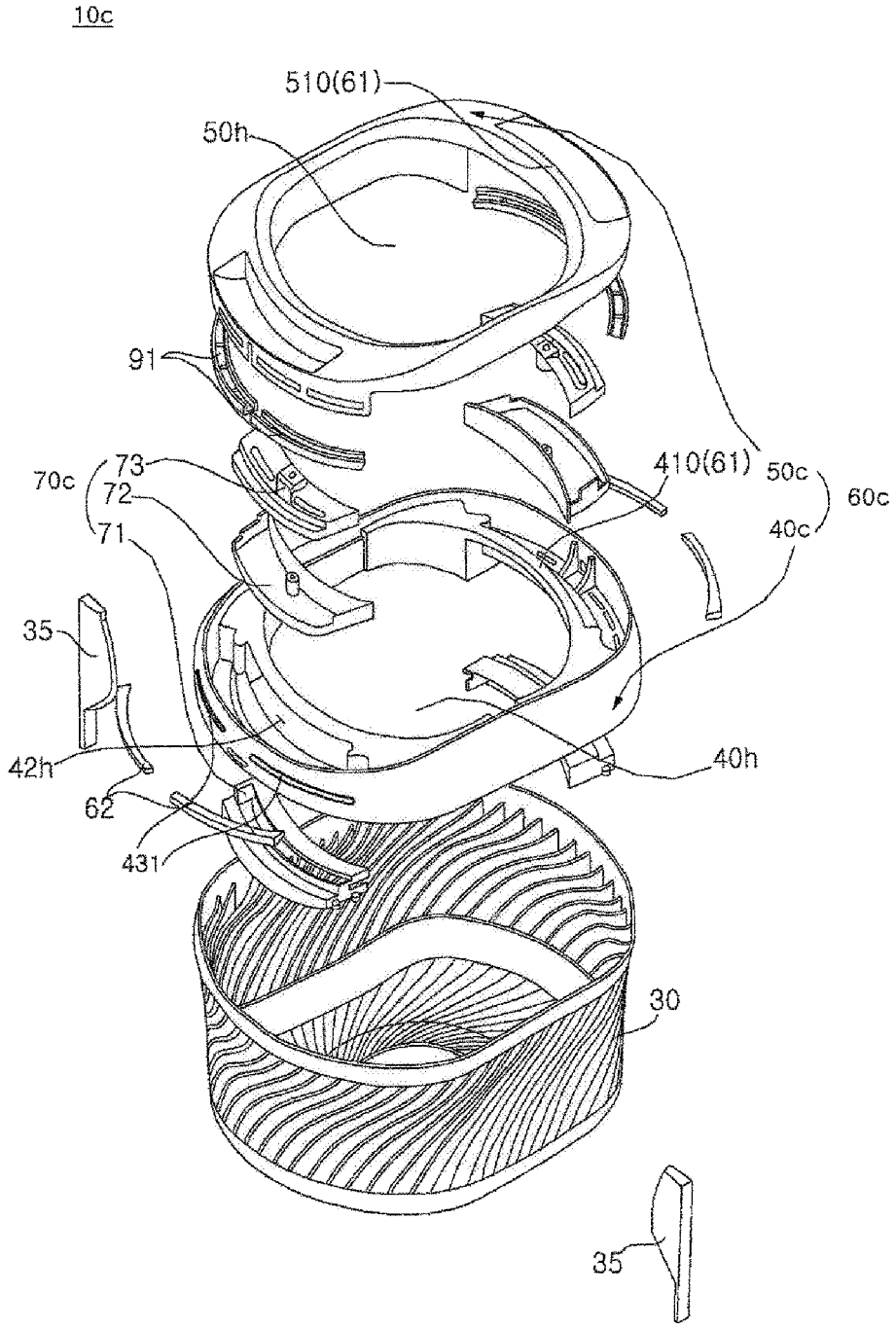
FIG. 28 is an exploded perspective view of a second washing tub in accordance with a third embodiment.
Figure 29:
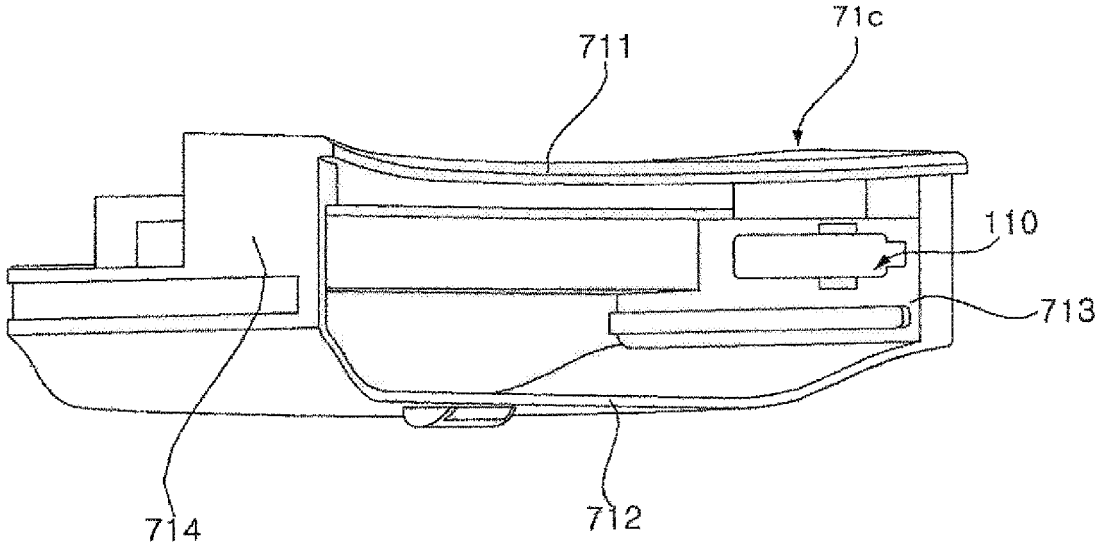
FIG. 29 is a perspective view illustrating an assembly of a drawer housing and a cover locker illustrated in FIG. 28.
Figure 30:
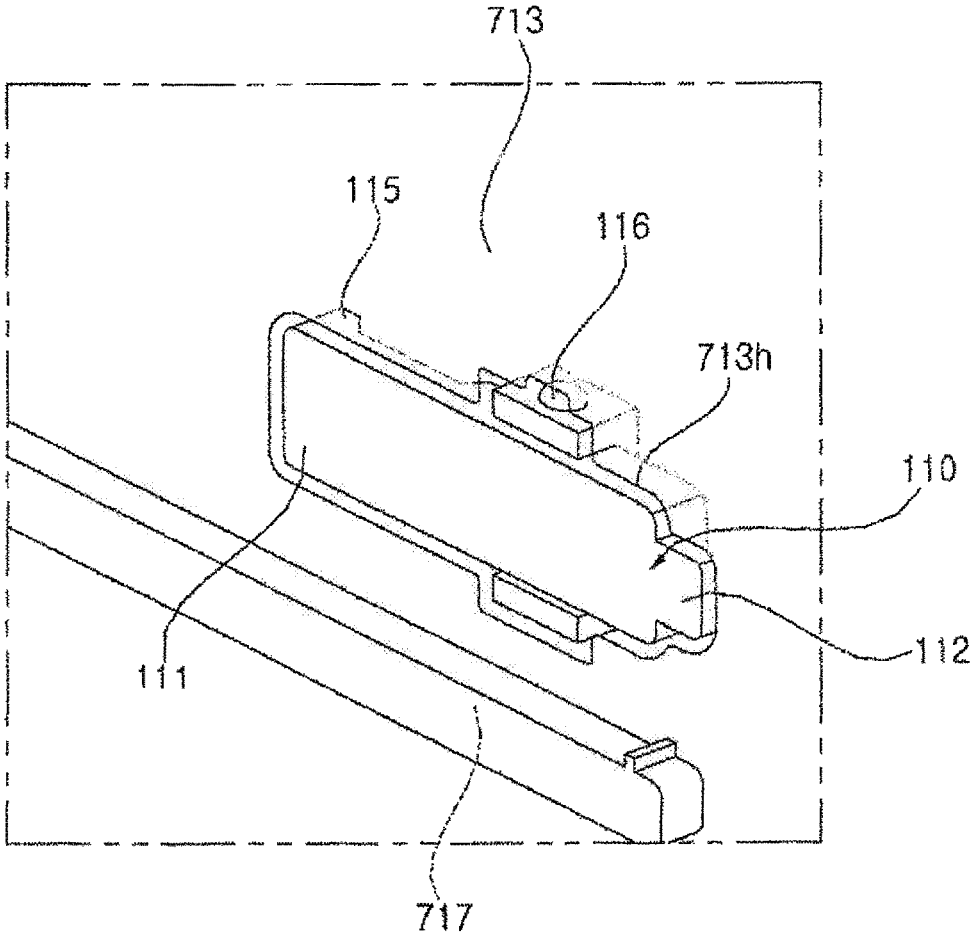
FIG. 30 is an enlarged view of the cover locker illustrated in FIG. 29.
Figure 31:
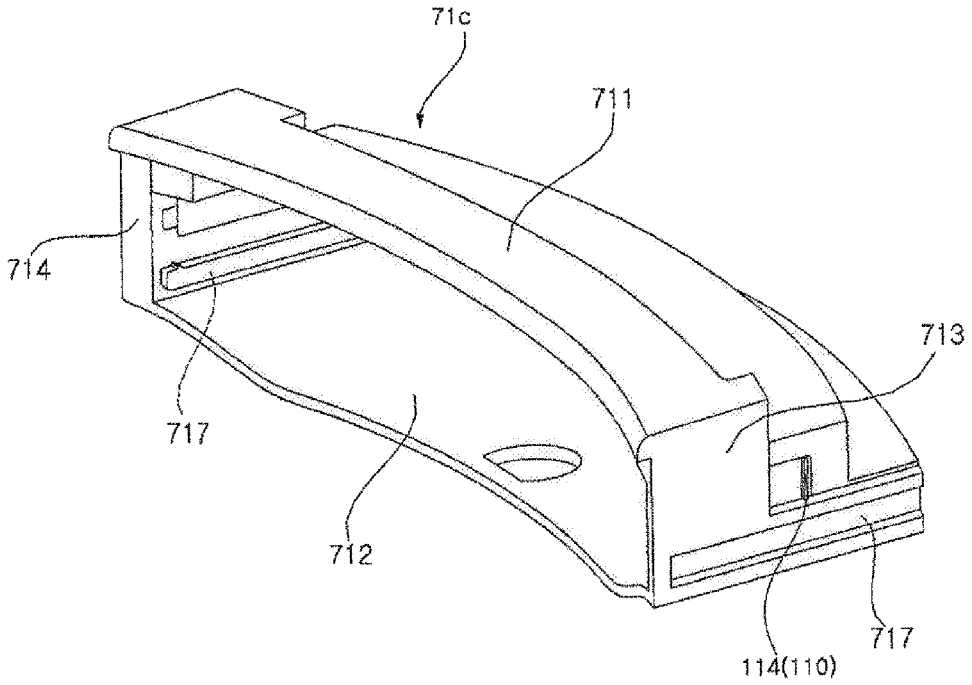
FIG. 31 is a perspective view illustrating the assembly of FIG. 29 when viewed from another angle.
Figure 32:
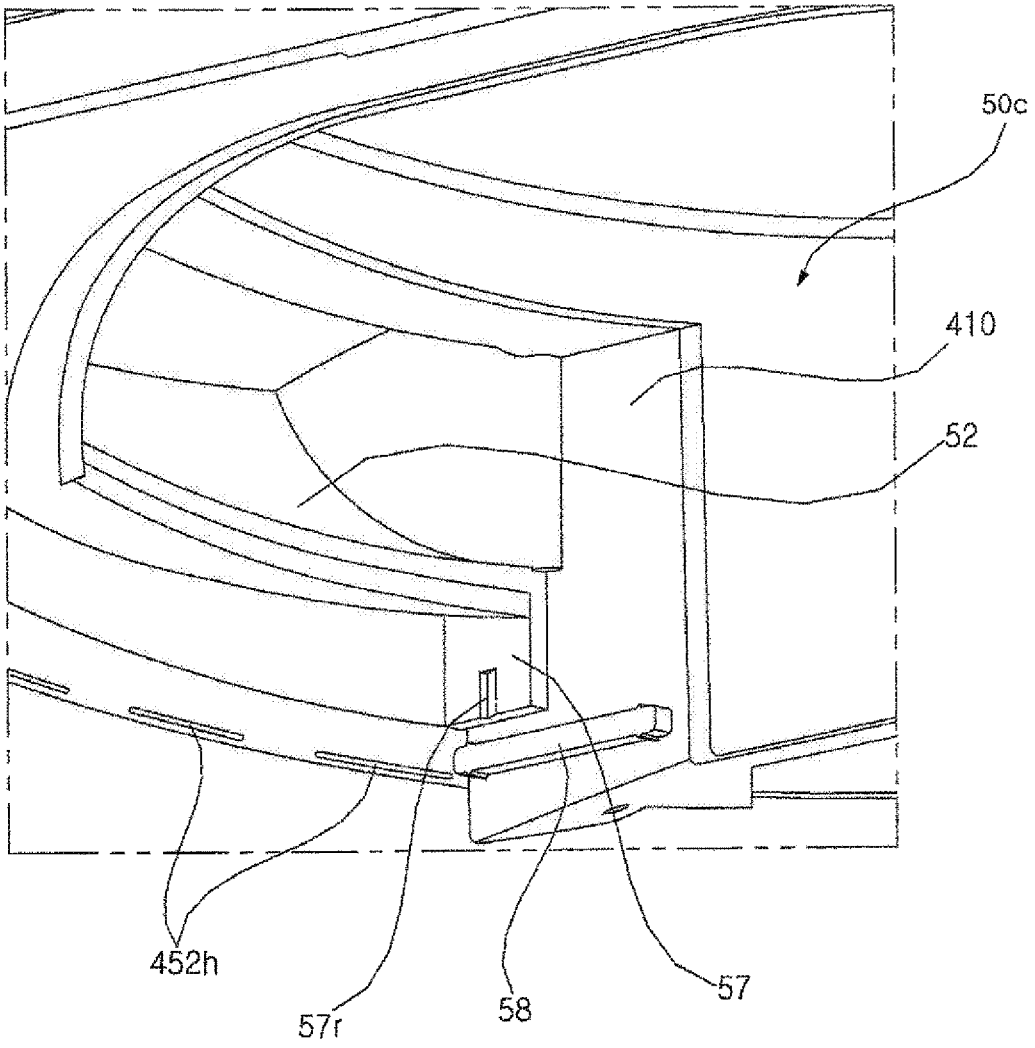
FIG. 32 is a diagram illustrating an assembly of the upper cover and the lower cover, particularly, the binding tab.
Figure 33:
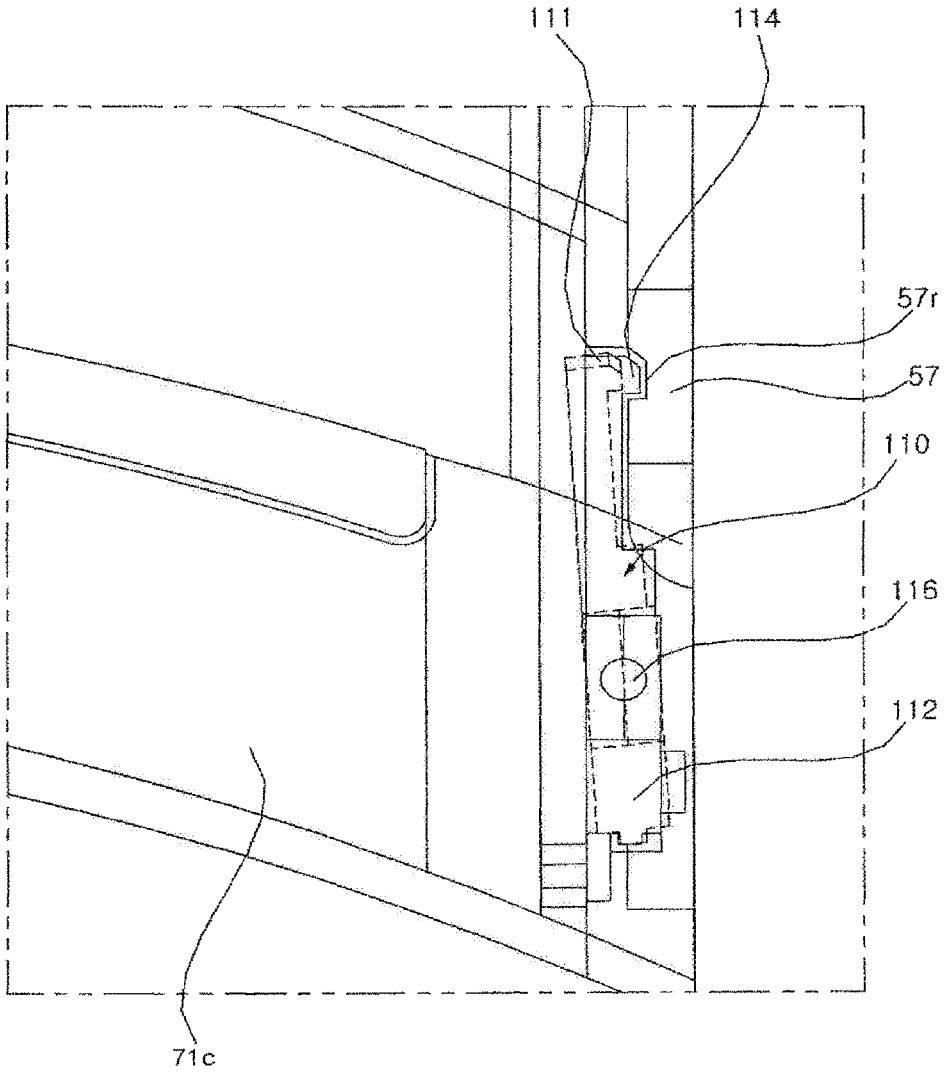
FIG. 33 illustrates a structure in which the cover locker and the binding tab are bound to each other, when seeing the drawer housing from bottom to top.

FIG. 28 is an exploded perspective view of a second washing tub 10*c* in accordance with a third embodiment. FIG. 29 is a perspective view illustrating an assembly of a drawer housing and a cover locker illustrated in FIG. 28. FIG. 30 is an enlarged view of the cover locker illustrated in FIG. 29. FIG. 31 is a perspective view illustrating the assembly of FIG. 29 when viewed from another angle. FIG. 32 is a diagram illustrating an assembly of the upper cover and the lower cover, particularly, the binding tab. FIG. 33 illustrates a structure in which the cover locker and the binding tab are bound to each other, when seeing the drawer housing from bottom to top.

Referring to FIGS. 28 to 33, as in the above-described embodiments, the second washing tub 10*c* includes a container 30 that contains laundry therein, and a washing-tub cover 60*c* that covers the container 30. The washing-tub cover 60*c* may include a lower cover 40*c*, and an upper cover 50*c* coupled to the top of the lower cover 40*c*.

A sub dispenser 70*c* may include a dispenser housing 71*c*, a drawer 72 that is retractably received in the dispenser housing 71*c* and is opened at a top thereof, and a drawer cover 73 that covers the opened top of the drawer 72. The drawer cover 73 may be detachably coupled to the drawer 72. An opening 73*h* is formed in the drawer cover 73 so that water discharged from the main dispenser 16 passes therethrough, and the water passing through the opening 73*h* is supplied to the drawer 72.

A cover locker 110 is disposed in the drawer housing 71*c*. The cover locker 110 locks the upper cover 50*c* to prevent it from being separated from the lower cover 40*c*. The cover locker 110 may be operated by a user's manipulation, and be automatically operated while the drawer housing 71*c* is introduced. This will be described below in more detail.

A rib 58 extending long in a predetermined direction is formed on any one of the lower cover 40*c* and the drawer housing 71*c*, while a slot 717 is formed in the remaining one of the lower cover and the drawer housing to engage with the rib 58. In the state where the rib 58 and the slot 717 engage with each other, the drawer housing 71*c* slides along the longitudinal direction of the rib 58 (or longitudinal direction of the slot 717) to reach a predetermined assembly position. Here, the assembly position is a position where the assembly of the drawer housing 71*c* is completed. According to an embodiment, a fastening member such as a screw or a bolt may be applied to fasten the drawer housing 71*c* that has reached the assembly position to the lower cover 40*c*, or a stopper (e.g. a catch projection, a hook, etc.) may be further provided to prevent the drawer housing 71*c* that has reached the assembly position from being introduced any more.

The upper cover 50*c* is provided with the binding tab 57. When the drawer housing 71*c* is in the assembly position, the cover locker 110 is bound to the binding tab 57. The cover locker 110 may be operated between the binding position and the unbinding position. The cover locker 110 may be normally maintained in the binding position by the restoring force of an elastic member such as a spring, and then may temporarily reach the unbinding position by a user's manipulation or by interference with the binding tab 57. For example, as the drawer housing 71*c* slides during its introduction, the cover locker 110 starts to interfere with the binding tab 57. Then, the cover locker 110 temporarily reaches the unbinding position. In this state, if the drawer housing 71*c* further slides, the cover locker 110 returns to the binding position to be bound to the binding tab 57. In other words, during the assembly of the drawer housing 71*c*, the cover locker 110 is automatically operated by the operation of introducing the drawer housing 71*c*, so that the cover locker is bound to the binding tab 57. Meanwhile, when one desires to separate the upper cover 50*c* from the lower cover 40*c*, a user may manipulate the cover locker 110 so that it reaches the unbinding position.

Meanwhile, the cover locker 110 may be a lever 110 that rotates about a predetermined support shaft. In other words, the lever 110 may be provided to be rotatable about a support shaft 116 that is rotatably connected to the drawer housing 71*c*, so that a first side 111 relative to the support shaft 116 may be bound to the binding tab 57. A hook 114 may be formed on the first side 111 of the lever 110, and a catch groove 57*r* may be formed in the binding tab 57 to engage with the hook 114. In an embodiment, the hook 114 may be horizontally rotated about the support shaft 116, and the catch groove 57*r* may be formed long vertically. A vertical side of the catch groove 57*r* may be caught by the hook 114. Particularly, a width of the catch groove 57*r* is approximately equal to a width of the hook 114, so that the horizontal movement of the binding tab 57 is limited. In an embodiment, a lower end of the catch groove 57*r* is opened.

However, the present disclosure is not limited thereto, and the lower end thereof may be closed. In the latter case, since the closed lower end of the catch groove 57*r* interferes with the hook 114, it is possible to more reliably prevent the binding tab 57 from being lifted.

The drawer housing 71*c* is shaped to surround the drawer 72, and is opened at a front thereof to allow the drawer 72 to go in and out, thus forming a drawer entryway. An opening is formed in the top portion 711 of the drawer housing 71*c*, so that water flowing down along the flow guide 52 in the water supply process passes through the opening and then is supplied to the drawer 72.

The drawer housing 71*c* has a bottom portion 712 that is formed on a bottom spaced apart from the top portion 711, and water discharged through the siphon pipe 724 of the drawer 72 flows along the bottom portion 712 to be supplied into the container 30.

The cover locker 110 may be installed on at least one of both side portions 713 and 714 connecting the top portion 711 and the bottom portion 712 of the drawer housing 71*c*. In an embodiment, the cover locker 110 is installed on each of both side portions 713 and 714, and a pair of binding tabs 57 is also provided to correspond to the side portions.

A lever installation opening 713*h* may be formed in each of the side portions 713 and 714 to make the inside/outside of the drawer housing 71*c* communicate with each other, and a lever 110 may be disposed in the lever installation opening 713*h*. The lever installation opening 713*h* has a shape corresponding to the appearance of the lever 110.

The lever 110 may be rotated by external force, acting on a second side relative to the support shaft 116, to be separated from the binding tab 57. For example, if a user presses the second side of the lever 110, the lever 110 rotates about the support shaft 116 to reach the unbinding position. At this time, the hook 114 is removed from the catch groove 57*r*. For reference, the solid line of FIG. 12 shows that the lever 110 is in the binding position, and the broken line thereof shows that the lever is in unbinding position.

The cover locker 110 may include the elastic member that applies the restoring force so that the lever 110 returns from the unbinding position to the binding position. In the state where the lever 110 reaches the unbinding position, the elastic member is deformed. In this state, if the external force (e.g. force of a user pressing the second side of the lever 110) is eliminated, the lever 110 is rotated by the restoring force of the elastic member to return to the binding position. The elastic member may be a spiral spring that is wound by the rotation of the lever 110.

Meanwhile, according to an embodiment, the cover locker 110 may be operated as the drawer 72 is taken out. For example, if the drawer 72 is introduced into the drawer housing 71*c* with the lever 110 being in the unbinding position, the hook 114 may engage with the catch groove 57*r* by rotating the lever 110 to the binding position during the movement of the drawer 72.

Hereinafter, a washing tub 10*d* in accordance with a fourth embodiment will be described with reference to FIGS. 34 to 40. The same reference numerals denote components common to the preceding embodiments and the fourth embodiment, and a duplicated description of the common components will be omitted.

Figure 34:
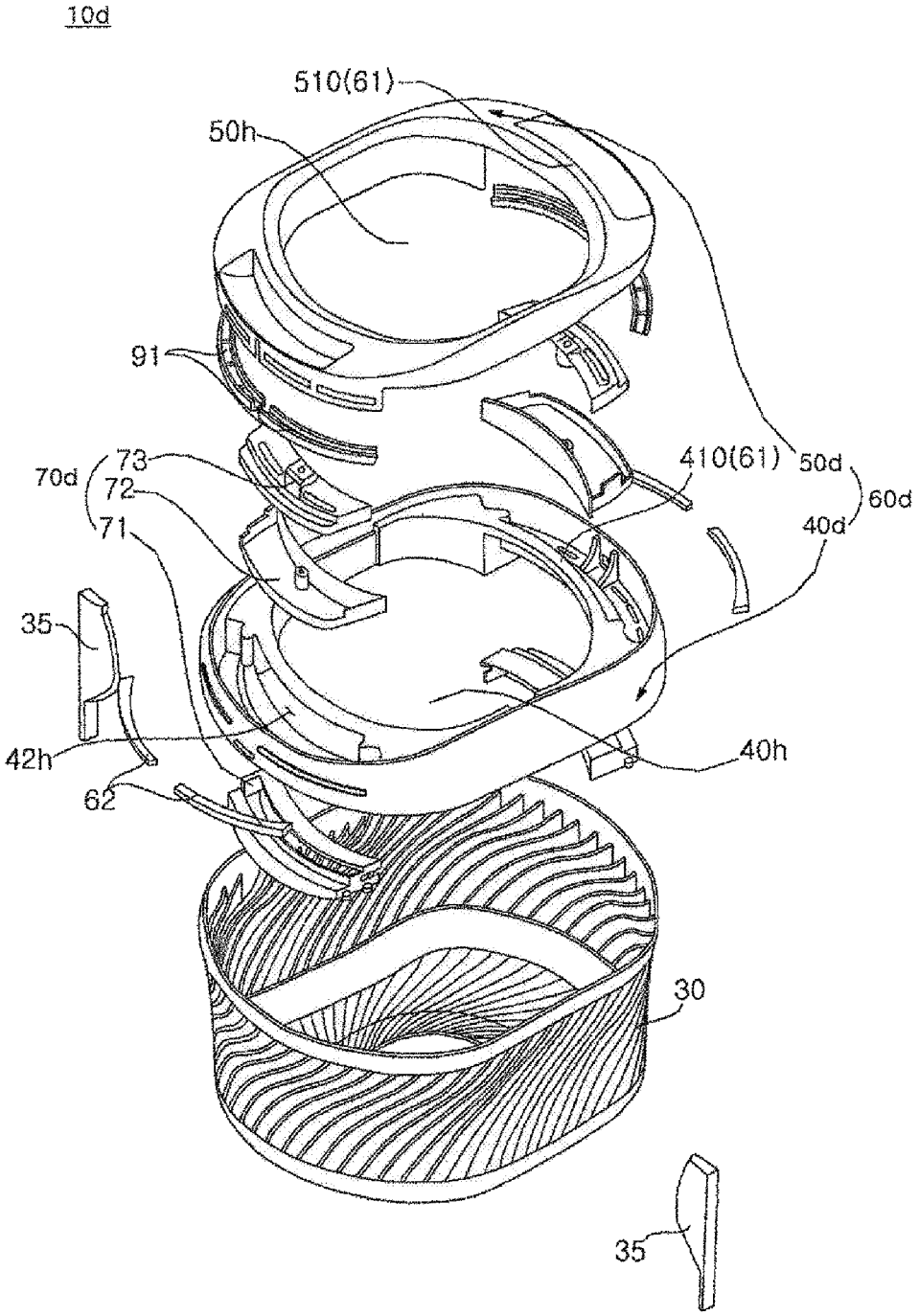
FIG. 34 is an exploded perspective view of a second washing tub in accordance with a fourth embodiment.
Figure 35:
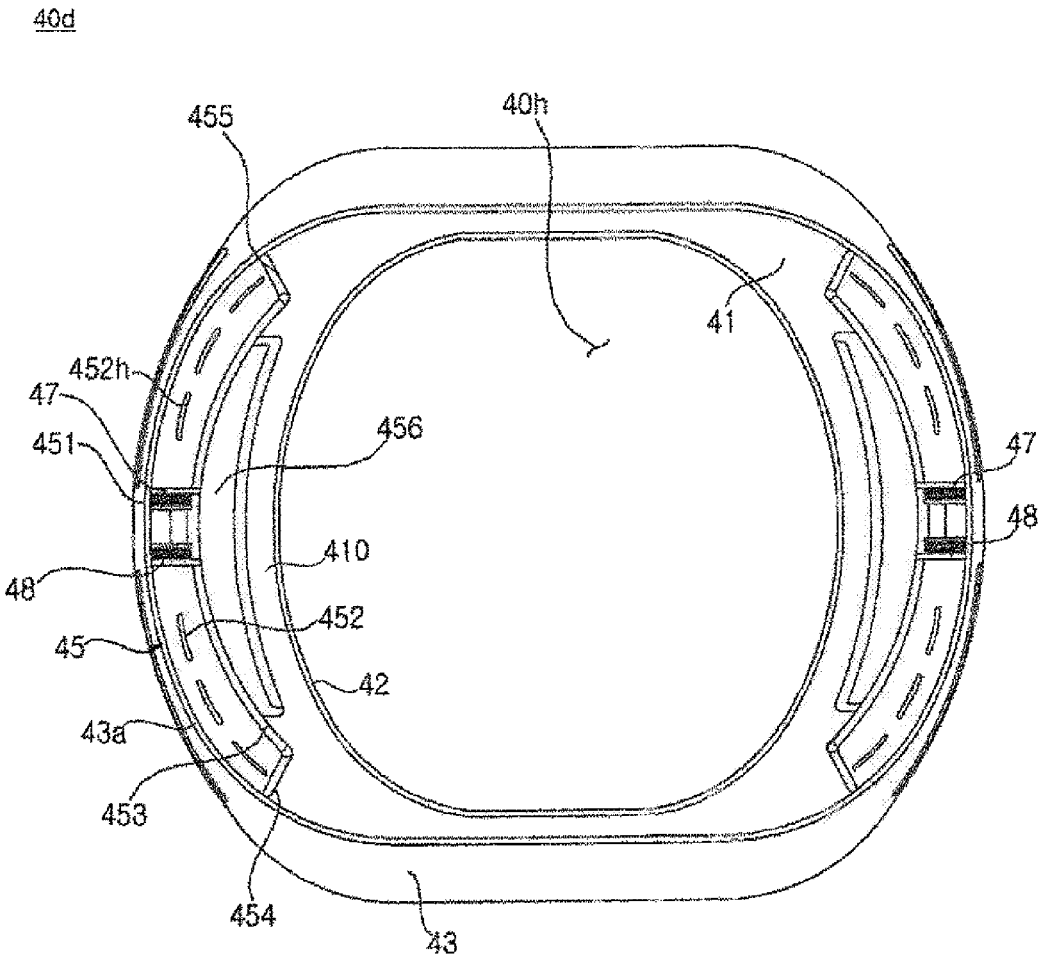
FIG. 35 is a diagram illustrating an upper cover illustrated in FIG. 34 when viewed from above.
Figure 36:
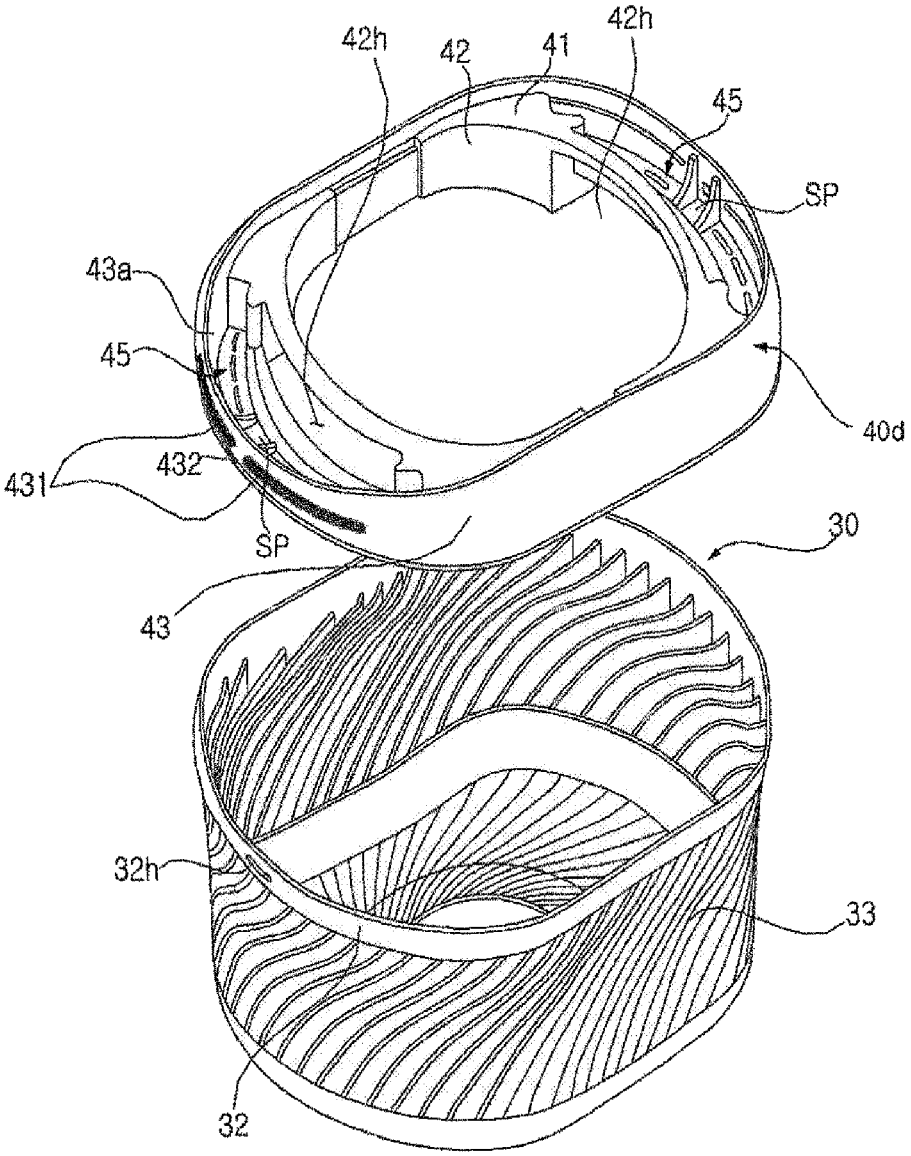
FIG. 36 illustrates a state in which the upper cover and a container are separated from each other in the second washing tub illustrated in FIG. 34.
Figure 37:
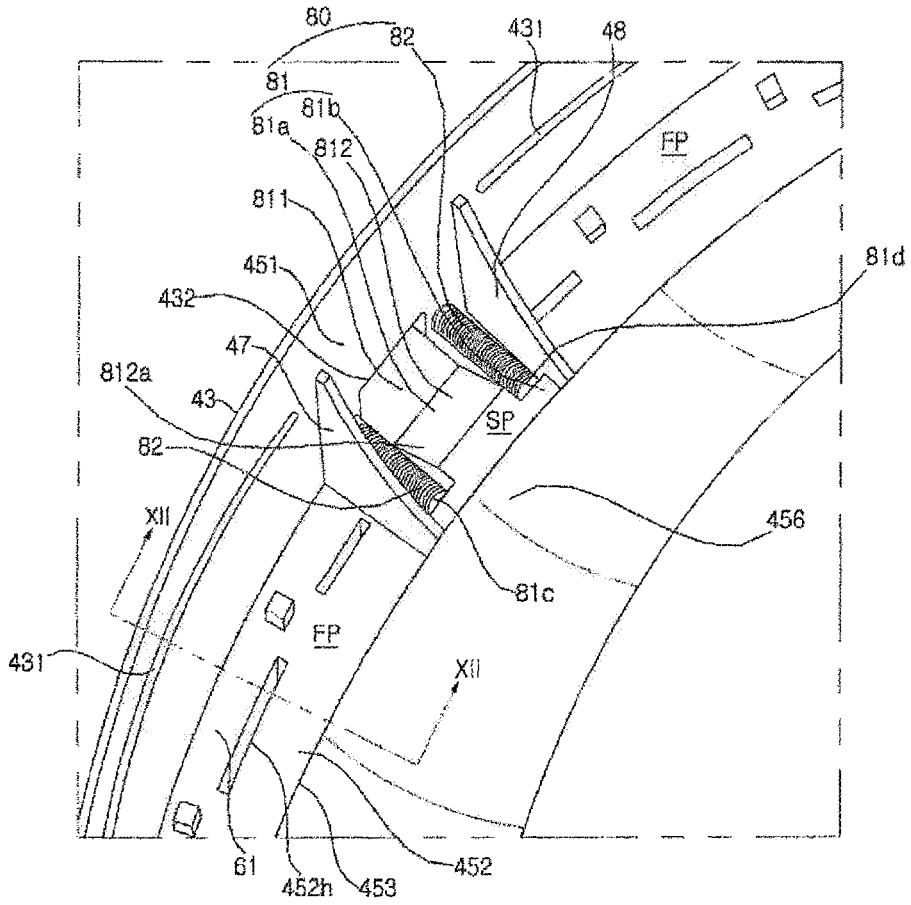
FIG. 37 illustrates a state in which a locker is installed on the upper cover of FIG. 36, particularly, a state in which the locker is disposed between a pair of partition walls.
Figure 38:
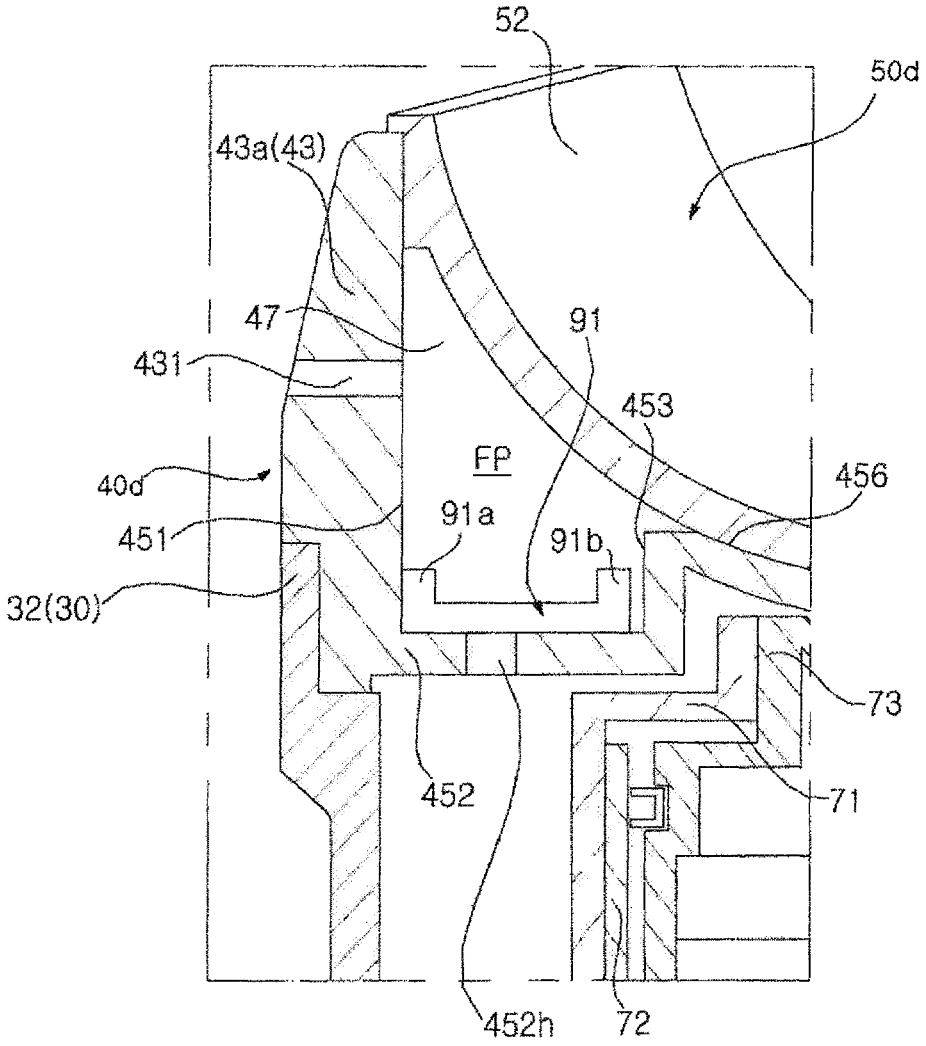
FIG. 38 is a sectional view taken along line XII-XII of FIG. 37.
Figure 39:
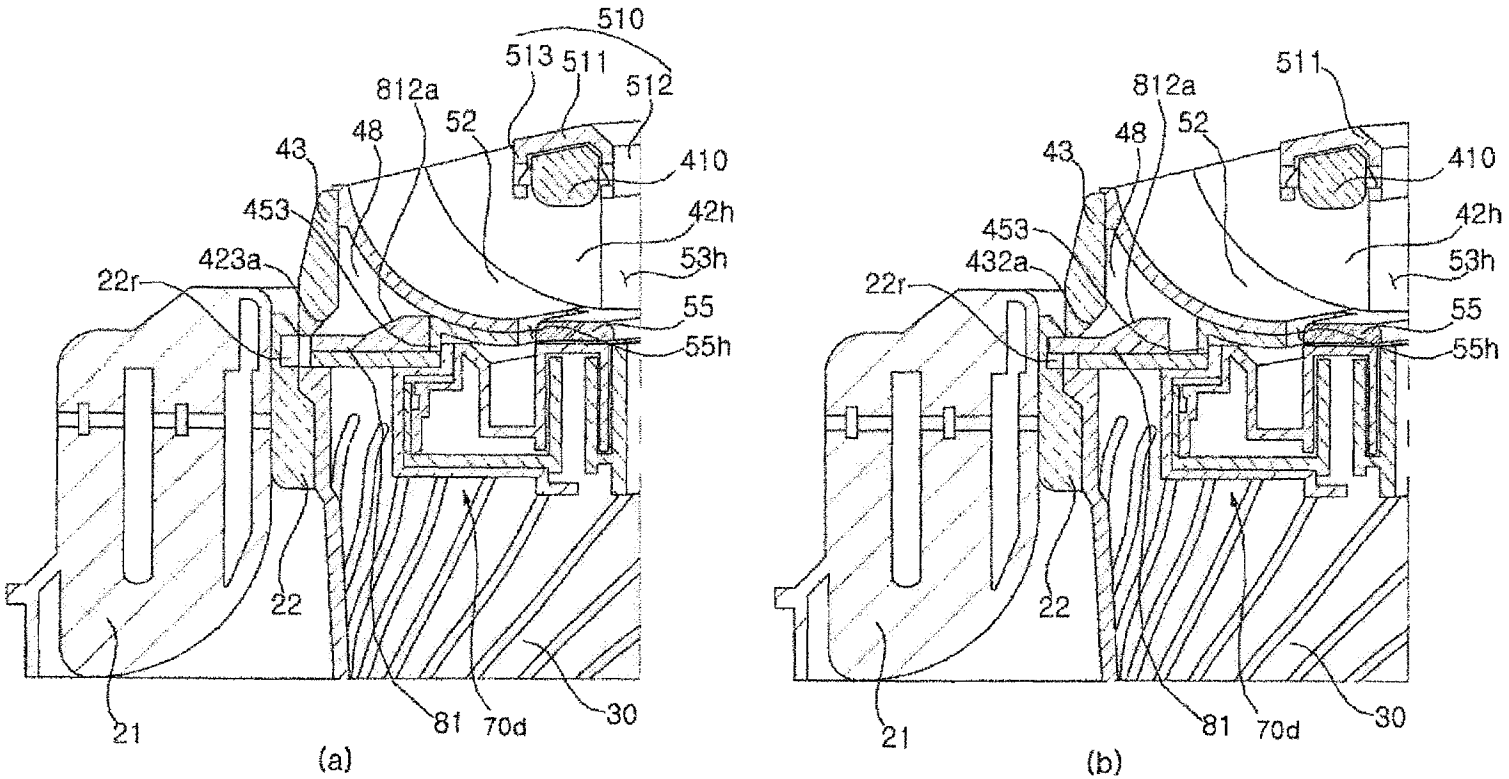
FIG. 39 is a partial sectional view of a fourth washing tub, in which FIG. 39(*a*) shows a state in which a locking member is in a first position, and FIG. 39(*b*) shows a state in which the locking member is in a second position.
Figure 40:
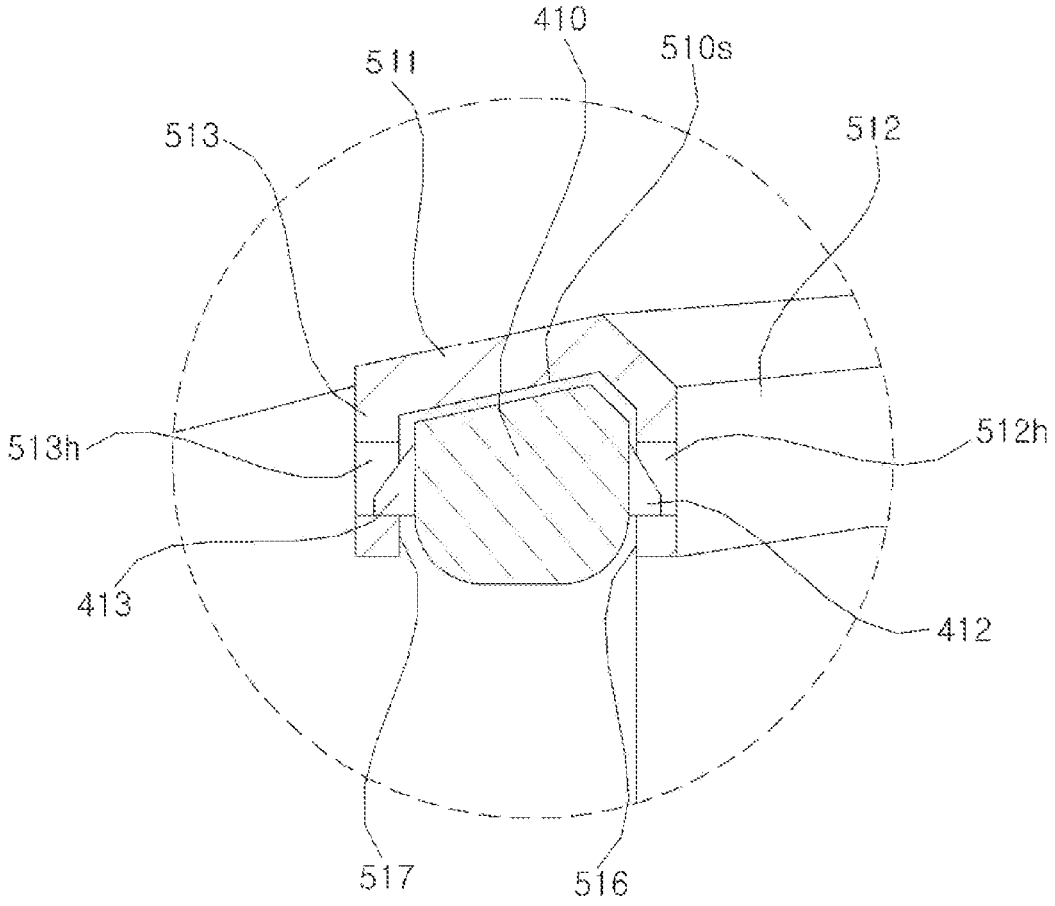
FIG. 40 is an enlarged view of a handle portion in FIG. 39.

FIG. 34 is an exploded perspective view of a second washing tub in accordance with a fourth embodiment. FIG. 35 is a diagram illustrating an upper cover illustrated in FIG. 34 when viewed from above. FIG. 36 illustrates a state in which the upper cover and a container are separated from each other in the second washing tub illustrated in FIG. 34. FIG. 37 illustrates a state in which a locker is installed on the upper cover of FIG. 36, particularly, a state in which the locker is disposed between a pair of partition walls. FIG. 38 is a sectional view taken along line XII-XII of FIG. 37. FIG. 39 is a partial sectional view of a fourth washing tub 10*d*, in which FIG. 39(*a*) shows a state in which a locking member is in a first position, and FIG. 39(*b*) shows a state in which the locking member is in a second position. FIG. 40 is an enlarged view of a handle portion in FIG. 39.

Referring to FIGS. 34, 35, 38 to 39, as in the above-described embodiments, the second washing tub 10*d* includes a container 30 that contains laundry therein, and a washing-tub cover 60*d* that covers the container 30. The washing-tub cover 60*d* may include a lower cover 40*d*, and an upper cover 50*d* coupled to the top of the lower cover 40*d*.

The lower cover 40*d* may include an internal handle 410 formed between the groove 45 and the first opening 40*h*. A first side surface of the internal handle 410 may be formed by the first inner-wall portion 42. In this case, the first side surface defines the first opening 40*h*. The opening 42*h* for installing the dispenser 70*d* is formed in the first side surface, and the opening 42*h* is formed to be higher than the dispenser 70*d*, so that a space is formed between the dispenser 70*d* and the internal handle 410 to allow a user's finger to pass therethrough when the user grips the handle 61.

Meanwhile, the groove 45 has an internal inner circumferential surface 453 that is formed to be radially spaced apart from the external inner circumferential surface 451. The internal inner circumferential surface 453 is located opposite to the external inner circumferential surface 451, and extends upwards from the bottom of the groove 45.

Both ends of the internal inner circumferential surface 453 are connected to the external inner circumferential surface 451 by groove inner surfaces 454 and 455, and thus an inside surrounded by the internal inner circumferential surface 453, the first groove inner surface 454, the second groove inner surface 455, and the external inner circumferential surface 451 is an area defined by the groove 45.

The inclined surface 456 may extend inwards in the radial direction from the upper end of the internal inner circumferential surface 453. In order to prevent water from penetrating a gap between the inclined surface 456 and the flow guide 52 of an upper cover 50*d* that will be described below, the inclined surface 456 is preferably in contact with the bottom of the flow guide 52.

The internal inner circumferential surface 453 is connected to the outer-wall portion 43 by a pair of partition walls 47 and 48. The locking member 81 that will be described below is preferably in contact with the internal inner circumferential surface 453 by the restoring force of a spring 82, in an unlock position (i.e. position of the locking member 81 when the second washing tub 10*d* is stopped).

The upper cover 50*d* may include a second top portion 51 in which the second opening 50*h* and the water supply port 51*h* are formed, and a second inner-wall portion 53 which extends downwards from the second top portion 51 around the second opening 50*h*. The water supply port 51*h* is located outside the second opening 50*h* in the radial direction.

The second top portion 51 may include an external handle 510 formed between the water supply port 51*h* and the second opening 50*h*. The external handle 510 may include a handle top portion 511 that belongs to the second top portion 51, a first handle side portion 512 that extends downwards from the handle top portion 511 around the second opening

50*h* and belongs to the second inner-wall portion 53, and a second handle side portion 513 that extends downwards from the handle top portion 511 around the water supply port 51*h*. In other words, the external handle 510 has a receiving groove 510*s* that is depressed in a bottom thereof facing the internal handle 410 located under the external handle. To be more specific, an "U"-shaped receiving groove 510*s* that is opened at a bottom is formed by the handle top portion 511, the first handle side portion 512, and the second handle side portion 513. The first handle side portion 512 forms a first side surface 516 of the receiving groove 510*s*, and the second handle side portion 513 forms a second side surface 517 of the receiving groove 510*s*.

The internal handle 410 is inserted into the receiving groove 510*s*. The first side surface 516 and the second side surface 517 face each other, and the internal handle 410 is inserted between the first side surface 516 and the second side surface 517. A user may hold both the internal handle 410 and the external handle 510, so that the upper cover 50*d* and the lower cover 40*d* are not separated from each other when the second washing tub 10*d* is lifted. Preferably, the internal handle 410 is tight-fitted between the first side surface 516 and the second side surface 517 of the receiving groove 510*s*.

A predetermined space is formed under the internal handle 410, and the space is connected with an opening 42*h* (see FIG. 36). The second opening 50*h* and the water supply port 51*h* communicate with each other through the space. The space may be located above the sub dispenser 70*d*. When a user holds the handle 61, four fingers except the thumb may be inserted into the water supply port 51*h*, and then may pass through the space and move out of the second opening 50*h*.

In order to more firmly couple the internal handle 410 and the external handle 510, a hook 412 or 413 may be formed on any one of the internal handle 410 and the external handle 510, and a catch groove 512*h* or 513*h* in which the hook 412 or 413 is caught may be formed in the remaining one of the internal handle and the external handle.

To be more specific, the first hook 412 may be formed on any one of the first side surface 516 of the receiving groove 510*s* and the first handle side portion 512, and the first catch groove 512*h* may be formed in the remaining one of the first side surface and the first handle side portion to engage with the first hook 412.

Likewise, the second hook 413 may be formed on any one of the second side surface 517 of the receiving groove 510*s* and the second handle side portion 513, and the second catch groove 513*h* may be formed in the remaining one of the second side surface and the second handle side portion to engage with the second hook 413.

Meanwhile, the opening 53*h* may be formed in the second inner-wall portion 53 of the upper cover 50*d* to correspond to a position of the opening 42*h* of the lower cover 40*d*. The first handle side portion 512 of the external handle 510 may be formed by the second inner-wall portion 53. In this case, the first handle side portion 512 defines the second opening 50*h*.

The height of the opening 53*h* is determined by the lower end of the first handle side portion 512. The lower end of the first handle side portion 512 may be substantially at the same height as the lower end of the second handle side portion 513.

Meanwhile, the flow guide 52 may be formed on the upper cover 50*d* to extend around the water supply port 51*h*, especially from a section located opposite the second handle side portion 513. In other words, the flow guide 52 extends from the second top portion 51, at a position that is spaced apart from the second handle side portion 513 outwards in the radial direction. The flow guide 52 extends gradually downwards as it goes inwards along the radial direction from the second top portion 51.

The above-described handle 61 may be composed of a plurality of handles. Particularly, the plurality of handles 61 may be a pair of handles 61 that are symmetrically disposed on both sides of the laundry feed opening 60*h*. In order to correspond to the plurality of handles 61, the external handle 510 may also be composed of a plurality of handles. These external handles 510 may include a first external handle 510(1) and a second external handle 510(2) that are symmetrically disposed on both sides of the second opening 50*h* (see FIG. 34).

Likewise, the internal handle 410 may also be composed of a plurality of handles, especially, a first internal handle 410(1) and a second internal handle 410(2) to correspond to the first external handle 510(1) and the second external handle 510(2), respectively. Each of the internal handles 410(1) and 410(2) is inserted into the receiving groove 510*s* formed in the corresponding external handles 510(1) and 510(2).

Meanwhile, referring to FIG. 38, the flow path FP may be formed in the washing-tub cover 60*d* to extend from the inlet 452*h* to the outlet 431. If the second washing tub 10*d* is rotated, the water stream developed outwards along the radial direction by the centrifugal force in the container 30 moves upwards along the inner surface of the container 30. After the water stream moved upwards as such flows through the inlet 452*h* into the flow path FP, the water stream is discharged through the outlet 431. As described above, the inlet 452*h* and the outlet 431 are formed in the lower cover 40*d*, and the upper cover 50*d* is combined with the lower cover 40*d* to define the flow path FP.

The flow path FP may be defined as an area formed by the bottom portion 452, the outer-wall portion 43, and the first inner-wall portion 42 of the lower cover 40*d*. The water introduced through the inlet 452*h* into the flow path FP is moved upwards along the inner surface of the sidewall portion 43*a* (i.e. external inner circumferential surface 451) and then is discharged through the outlet 431. At this time, the remaining water that is not discharged through the outlet 431 is not moved upwards by the bottom of the upper cover 50*d*. When the capacity of the flow path FP is sufficient, most of the water in the flow path FP is compressed against the external inner circumferential surface 451 by the centrifugal force, so that the water stream reaching up to the internal inner circumferential surface 453 is not substantially generated. Therefore, according to an embodiment, the internal inner circumferential surface 453 may not contribute to the role of defining the flow path FP.

The check valve 91 may be further provided on the lower cover 40*d* to open or close the inlet 452*h*. The check valve 91 may be configured to be opened or closed by the centrifugal force generated by the rotation of the second washing tub 10*d* or to be opened or closed by water pressure.

The check valve 91 may be disposed in the groove 45. A bottom of the check valve 91 may be in close contact with the top of the bottom portion 452 (i.e. bottom surface of the groove 45), an outer end 91*a* thereof may be fixed to the bottom portion 452, and an inner end 91*b* located at an inner position than the outer end 91*a* along the radial direction may be rotated about the outer end 91*a*. In order to fix the outer end 91*a*, a rib (not shown) for pressing the top of the check valve 91 may protrude from the bottom of the upper cover 50*d*.

The check valve 91 may be made of a material having some elasticity, such as rubber. In this case, the check valve 91 is rotated by the pressure of the water stream passing through the inlet 452*h*, and moment generated by the centrifugal force with the outer end 91*a* as an action point, thus opening the inlet 452*h*. If the second washing tub 10*d* is stopped or decelerated, the check valve returns to its original position by its own weight and the restoring force of the material, thus closing the inlet 452*h*.

However, without being limited thereto, according to an embodiment, the outer end 91*a* may be rotatably connected to the bottom portion 452, so that the check valve 91 may pivot about a portion in which the outer end 91 and the bottom portion 452 are connected. In this case, the check valve 91 may be made of an inelastic material.

A wash course using the second washing tub 10*d* may include a wash cycle and a drain cycle. In the wash cycle, the rotating speed of the second washing tub 10*d* is preferably set such that the water stream in the container 30 does not reach the inlet 452*h*. At this time, the rotating speed of the second washing tub 10*d* may be changed according to the water level in the container 30. However, according to an embodiment, in the case where the quantity of water supplied to the container 30 is configured to be always constant in the wash cycle, the rotation speed of the second washing tub 10*d* may be determined by an experiment when the water stream starts to reach the inlet 452*h*, on the basis of a case where a preset fixed quantity (i.e. an input quantity reported to a user through product instructions or the like) of cloth is put. In order not to exceed the rotation speed determined in this manner, the controller may control the rotating speed of the second washing tub 10*d* in the wash cycle.

Otherwise, the rotation speed of the second washing tub 10*d* in the wash cycle may be controlled, within a range where the water pressure acting through the inlet 452*h* does not overcome the moment acting in a direction where the inlet is closed by the own weight of the check valve 91, even if the water stream moved upwards in the container 30 reaches the inlet 452*h*.

Referring to FIGS. 37 to 39, the washing machine according to an embodiment of the present disclosure includes a locker 80 that is provided on the second washing tub 10*d* and secures the second washing tub to prevent it from being removed from the first washing tub 6 during the rotation of the second washing tub 10*d*. The locker 80 may be provided on the lower cover 40*d*.

The locker 80 includes a locking member 81 and an elastic member 82. The locking member 81 is located in a first position (see FIG. 39(*a*), hereinafter referred to as the "unlock position") in a state where the second washing tub 10*d* is stopped, and is moved from the first position to a second position (see FIG. 39(*b*), hereinafter referred to as the "lock position") by the centrifugal force when the second washing tub 10*d* is rotated. The lock position is outside the unlock position in the radial direction.

The locking member 81 engages with the first washing tub 6 in the lock position to secure the second washing tub 10*d* to the first washing tub 6. A straight line connecting from the unlock position to the lock position (i.e. a moving line of the locking member 81) may cross the first section 51 (see FIG. 6).

A locking groove 22*r* into which the locking member 81 is inserted in the lock position may be formed in the balancer 20. The locking groove 22*r* may be formed in the inner-diameter portion of the balancer body 21. If the second washing tub 10*d* is mounted on the ring-shaped balancer 20 and is rotated at a predetermined speed or higher while being aligned in a preset rotation position, the locking member 81 is moved outwards in the radial direction by the centrifugal force to reach the lock position. In this process, the locking member 81 is inserted into the locking groove 22*r*. Even if the second washing tub 10*d* is shaken or vibrated during the rotation, the removal of the second washing tub 10*d* is prevented because the locking member 81 and the locking groove 22*r* engage with each other. Particularly, since the upward movement of the second washing tub 10*d* is restrained, the second washing tub 10*d* does not collide with the top cover 3 or a door (not shown). Even when the second washing tub 10*d* is rotated at high speed (e.g. a spin-dry cycle), damage to devices may be prevented, and accidents may also be prevented.

Since the second washing tub 10*d* is locked not by a separate power mechanism (e.g. motor) but by the centrifugal force that is generated by the rotation of the second washing tub 10*d*, it has advantages in that a lock structure is simplified and it is unnecessary to provide a special control for the lock.

The elastic member 82 is elastically deformed when the locking member 81 is in the lock position, and is restored to its original state when the second washing tub 10*d* stops rotating, so that the locking member 81 returns to the unlock position. If the second washing tub 10*d* stops rotating, the locking member 81 is restored to the unlock position by the restoring force of the elastic member 82, so that the lock is automatically released. If the washing operation is completed, the lock is automatically released, so that the second washing tub 10*d* may be easily lifted without a user performing a separate operation for releasing the lock.

The elastic member 82 may be a coil spring that is compressed when the locking member 81 moves from the unlock position to the lock position. The locking member 81 may include a spring mount 81*b* that is elastically biased by the spring 82, and a head 81*a* that protrudes from the spring mount 81*b*. The spring mount 81*b* may include spring fixing projections 81*c* and 81*d* formed on both protruding portions of the head 81*a*, and a pair of springs 82 may be fitted over the fixing projections 81*c* and 81*d*. In other words, the first end of the spring 82 may be located on the inner surface (i.e. external outer circumferential surface 451) of the outer-wall portion 43, and the second end thereof may elastically bias the spring mount 81*b*. A pair of projections (not shown) may protrude from the external inner circumferential surface 451 of the groove 45, so that the first end of the spring 82 may be fitted over each of projections 435*a* and 435*b*.

In the unlock position, the locking member 81 may come into contact with the internal inner circumferential surface 453 of the groove 45 by the restoring force of the spring 82. In the unlock position, the locking member 81 may be stably maintained without being shaken.

Referring to FIG. 37, the lower cover 40*d* may have a first penetration part 432 formed on the outer-wall portion 43. The head 81*a* may be located within the first penetration part 432. Preferably, even if the locking member 81 is located at any point between the unlock position and the lock position, the head 81*a* is always located in the first penetration part 432.

Meanwhile, the container 30 may include the container body 31, and a rim portion 32 (see FIGS. 2 and 38) that is formed on the upper end of the container body 31 and surrounds the outer-wall portion 43 outside the lower cover 40*d*. The rim portion 32 may be formed on the upper end of the container body 31, namely, along the circumference of the opening in the top of the container 30. A second penetration part 32*h* may be formed on the rim portion 32 to communicate with the first penetration part 432. The head

81*a* passes through the second penetration part 32*h* to protrude out of the second washing tub 10*d*.

The head 81*a* may include an insert portion 811 that is inserted into the locking groove 22*r*, and a catch portion 812 that is a portion connecting the insert portion 811 and the spring mount 81*b*, with a portion connected with the spring mount 81*b* having a sectional area that is larger than a passage area of the first penetration part 432. The insert portion 811 may pass through the first penetration part 432, whereas the catch portion 812 may not pass therethrough.

A section of the head 81*a* taken along a plane perpendicular to the longitudinal direction (i.e. a moving line of the locking member 81) has a rectangular shape. The first penetration part 432 may be formed such that an exit located on the outer surface of the outer-wall portion 43 corresponds to a section of the insert portion 811, and an entrance located on the inner surface of the outer-wall portion 43 corresponds to a section of the catch portion 812. The catch portion 812 may include a first inclined surface 812*a* (see FIG. 13) that gradually extends downwards from the portion connected to the spring mount 81*b* towards the insert portion 811. A second inclined surface 432*a* corresponding to the first inclined surface may be formed between the entrance and the exit of the first penetration part 432.

A pair of partition walls 47 and 48 is formed on the lower cover 40*d*. A space SP is provided between the pair of partition walls 47 and 48 to accommodate a locker 80 therein. The space SP is separated from the flow path FP by the pair of partition walls 47 and 48. Each of the partition walls 47 and 48 may extend from the bottom portion 452 to the outer-wall portion 43. Furthermore, each of the partition walls 47 and 48 is connected to the internal inner circumferential surface 453. In other words, the space SP is surrounded by the outer-wall portion 43, the pair of partition walls 47 and 48, and the internal inner circumferential surface 453, and is opened at its top. The opened top is closed again by the bottom of the upper cover 50*d*.

Particularly, the upper ends of the partition walls 47 and 48 come into close contact with the bottom of the upper cover 50*d*, thus preventing water contained in the flow path FP from overflowing the partition walls 47 and 48 and flowing into the space SP. The bottom of the flow guide 52 may come into close contact with the upper ends of the partition walls 47 and 48.

In an embodiment, in order to more reliably maintain air-tightness between the partition walls 47 and 48 and the upper cover 50*d*, a sealer (not shown) may be provided to seal gaps between the upper ends of the pair of partition walls 47 and 48 and the bottom of the upper cover 50*d*. The sealer is made of a soft material (e.g. rubber) to be interposed between the pair of partition walls 47 and 48 and the bottom of the upper cover 50*d*. In this case, one surface of the sealer is pressed by the partition walls 47 and 48, while the other surface is pressed by the bottom of the upper cover 50*d*.

Although the present disclosure was described with reference to specific embodiments, it is apparent to those skilled in the art that the present disclosure may be changed and modified in various ways without departing from the scope of the present disclosure, which is described in the following claims.

The invention claimed is:

1. A washing machine, comprising:

a first washing tub rotated about a vertical axis; and a second washing tub detachably coupled to the first washing tub, and rotated integrally with the first washing tub, wherein the second washing tub comprises:

a container containing laundry;

a lower cover coupled to a top of the container, and having an inlet into which a water stream moving upwards in the container when the first washing tub rotates is introduced, and an outlet for discharging water introduced through the inlet;

an upper cover coupled to a top of the lower cover, and defining a flow path that extends from the inlet to the outlet;

a drawer receiving an additive;

a drawer housing coupled to the lower cover, the drawer being retractably accommodated in the drawer housing; and a cover locker disposed on the drawer housing, a rib extending long in a predetermined direction is formed on any one of the lower cover and the drawer housing, while a slot is formed in the remaining one of the lower cover and the drawer housing to engage with the rib, so that, in a state where the rib and the slot engage with each other, the drawer housing slides along a longitudinal direction of the rib to reach a predetermined assembly position, and the upper cover comprises a binding tab that is bound to the cover locker, when the drawer housing reaches the assembly position.

2. The washing machine of claim 1, wherein the cover locker is bound to the binding tab, when the drawer housing reaches the assembly position during sliding.

3. The washing machine of claim 1, wherein the cover locker comprises:

a lever provided to be rotatable about a support shaft that is secured to the drawer housing, so that a first side of the lever relative to the support shaft is bound to the binding tab.

4. The washing machine of claim 3, wherein the lever is rotated by external force, acting on a second side thereof relative to the support shaft, to be unbound from the binding tab.

5. The washing machine of claim 4, wherein the cover locker further comprises:

an elastic member restoring the lever to an original position thereof when the external force is eliminated.

6. The washing machine of claim 5, wherein the elastic member is a spiral spring.

7. The washing machine of claim 3, wherein a hook is provided on a second side of the lever, and the binding tab comprises a groove engaging with the hook.

8. The washing machine of claim 3, wherein the drawer housing guides water that is mixed with detergent while passing through the drawer, when water is supplied to the drawer.

9. The washing machine of claim 8, wherein the drawer comprises a siphon pipe, a drawer cover having a siphon cover is further provided, with a discharge path being formed between the siphon cover and the siphon pipe, and the drawer housing guides water discharged through the siphon pipe to the container.

10. The washing machine of claim 2, wherein the upper cover comprises a flow guide, and the binding tab protrudes downwards from the flow guide.

* * * * *